US009856874B2

(12) United States Patent
Roof et al.

(10) Patent No.: US 9,856,874 B2
(45) Date of Patent: Jan. 2, 2018

(54) HOLDING PLATE FOR PILOTED SCROLL COMPRESSOR

(71) Applicants: Johnathan P. Roof, Zeeland, MI (US); Xianghong Wang, San Diego, CA (US); Carl F. Stephens, Liverpool, NY (US); Christopher Allen Wyker, Liverpool, NY (US)

(72) Inventors: Johnathan P. Roof, Zeeland, MI (US); Xianghong Wang, San Diego, CA (US); Carl F. Stephens, Liverpool, NY (US); Christopher Allen Wyker, Liverpool, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 110 days.

(21) Appl. No.: 14/801,233

(22) Filed: Jul. 16, 2015

(65) Prior Publication Data

US 2016/0090985 A1 Mar. 31, 2016

Related U.S. Application Data

(60) Provisional application No. 62/056,010, filed on Sep. 26, 2014.

(51) Int. Cl.

| | |
|---|---|
| ***F01C 1/02*** | (2006.01) |
| ***F04C 18/02*** | (2006.01) |
| ***F04C 29/00*** | (2006.01) |

(52) U.S. Cl.
CPC ..... *F04C 18/0253* (2013.01); *F04C 18/0215* (2013.01); *F04C 29/0057* (2013.01); *F04C 29/0085* (2013.01)

(58) Field of Classification Search
CPC ..... F04C 18/0215; F04C 18/0253; F04C 29/0057; F04C 29/0085
See application file for complete search history.

(56) References Cited

U.S. PATENT DOCUMENTS

| | | | | |
|---|---|---|---|---|
| 4,609,334 | A * | 9/1986 | Muir | F01C 1/0215 418/150 |
| 4,840,545 | A * | 6/1989 | Moilanen | F04C 28/28 417/301 |
| 5,178,526 | A | 1/1993 | Galante et al. | |
| 5,407,335 | A | 4/1995 | Caillat et al. | |
| 5,580,230 | A * | 12/1996 | Keifer | F01C 1/0215 418/55.5 |
| 5,897,306 | A | 4/1999 | Beck | |

(Continued)

*Primary Examiner* — Jesse Bogue
(74) *Attorney, Agent, or Firm* — Reinhart Boerner Van Deuren P.C.

(57) ABSTRACT

A scroll compressor that includes a housing and scroll compressor bodies disposed in the housing. The scroll bodies include a non-orbiting scroll body (also referred to as "fixed") and a moveable body, where scroll bodies have respective bases and respective scroll ribs that project from the respective bases. The scroll ribs are configured to mutually engage, and the movable scroll body orbits relative to the fixed scroll body for compressing fluid. A pilot ring engages a perimeter surface of the fixed scroll body to limit movement of the fixed scroll body in the radial direction. A simplified holding plate prevents rotation between the pilot ring and the fixed scroll body.

27 Claims, 17 Drawing Sheets

(56) References Cited

U.S. PATENT DOCUMENTS

| | | | | |
|---|---|---|---|---|
| 6,120,255 | A * | 9/2000 | Schumann | F04C 18/0215 417/213 |
| 6,398,530 | B1 | 6/2002 | Hasemann | |
| 6,814,551 | B2 | 11/2004 | Kammhoff et al. | |
| 6,960,070 | B2 | 11/2005 | Kammhoff et al. | |
| 7,112,046 | B2 | 9/2006 | Kammhoff et al. | |
| 7,275,918 | B2 | 10/2007 | Liang et al. | |
| 7,547,202 | B2 * | 6/2009 | Knapke | F04C 18/0215 417/213 |
| 8,702,406 | B2 * | 4/2014 | Reinhart | F04C 18/0215 418/1 |
| 2009/0068044 | A1 | 3/2009 | Guo et al. | |
| 2013/0251568 | A1 | 9/2013 | Bush | |

* cited by examiner

HOLDING PLATE FOR PILOTED SCROLL COMPRESSOR

CROSS-REFERENCE TO RELATED PATENT APPLICATIONS

This patent application claims the benefit of U.S. Provisional Patent Application No. 62/056,010, filed Sep. 26, 2014, the entire teachings and disclosure of which are incorporated herein by reference thereto.

FIELD OF THE INVENTION

The present invention generally relates to scroll compressors for compressing refrigerant and more particularly to an apparatus for controlling and/or limiting at least one of relative axial, radial, and rotational movement between scroll members during operation of the scroll compressor.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressor assemblies conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purposes of compressing refrigerant. An appropriate drive unit, typically an electric motor, is provided usually within the same housing to drive the movable scroll member.

In some scroll compressors, it is known to have axial restraint, whereby the fixed scroll member has a limited range of movement. This can be desirable due to thermal expansion when the temperature of the orbiting scroll and fixed scroll increases causing these components to expand. Examples of an apparatus to control such restraint are shown in U.S. Pat. No. 5,407,335, issued to Caillat et al., the entire disclosure of which is hereby incorporated by reference. Another example is U.S. Publication No. 2013/0251568 to Bush (and assigned to the current assignee), the entire disclosure of which is hereby incorporated by reference.

The present invention is directed towards improvements over the state of the art as it relates to the above-described features and other features of scroll compressors.

BRIEF SUMMARY OF THE INVENTION

A first inventive aspect of the present invention is directed toward a holding plate in a scroll compressor that forms surface to surface contact with the non-orbiting scroll body along a contact surface oriented in a direction transverse to an axis of the scroll compressor bodies. The scroll compressor comprises a housing; an orbiting scroll body in the housing, and a non-orbiting scroll body in the housing. The orbiting scroll body including a first base and a first scroll rib with the first scroll rib projecting from the first base. The non-orbiting scroll body including a second base and a second scroll rib with the second scroll rib projecting from the second base. The first and second scroll ribs mutually engage with the orbiting scroll body being movable along an orbital path about an axis relative to the a non-orbiting scroll body for compressing of fluid. A pilot ring is positioned to engage a piloted surface of the non-orbiting scroll body to limit movement of the non-orbiting scroll body in a radial direction. A holding plate secures the pilot ring and the non-orbiting scroll body to prevent rotation between the non-orbiting scroll body and the pilot ring. A gap is maintained and defined between the pilot ring and the piloted surface of 1 millimeter or less for piloting movement. The holding plate forming surface to surface contact with the non-orbiting scroll body along a contact surface oriented in a direction transverse to the axis.

The holding plate can form surface to surface contact with the non-orbiting scroll body in a plane horizontal and perpendicular to the axis, with the compressor axis being vertical.

The holding plate may include horizontally flat top and bottom surfaces extending a full length of the holding plate.

In embodiments, to facilitate holding plate attachment, the non-orbiting scroll body comprises a shoulder along an upper side at an outer periphery thereof, the shoulder having including a raised boss region with a machined flat extending horizontally (and preferably horizontal perpendicular to the axis), the machined flat forming said surface to surface contact of the non-orbiting scroll with the holding plate.

In certain embodiments, the holding plate includes opposite end regions and a central region, the central region located between the opposite end regions. The central region is secured to the non-orbiting scroll body and the opposite end regions are secured to the pilot ring. Each region includes a mounting hole with each mounting hole projecting in a direction vertically through the holding plate.

The holding plate may comprise top and bottom surfaces with an outer peripheral edge connecting the top and bottom surfaces. The holding plate includes a length extending horizontally, a width extending horizontally transverse to the length, and a thickness extending vertically transverse to the length and the width. Preferably, the width being smaller than the length and greater than the thickness throughout the holding plate over an entire span of the holding plate.

The holding plate may also include reduced neck regions on opposite sides of the central region. Each neck region may reside between one of the opposite end regions and the central region. As a result, the cross-sectional area (e.g. width and/or thickness in the region of the width) can be variable and cover a reduced span in the neck regions that afford additional flexibility sufficient to allow contact between the non-orbiting scroll body and the pilot ring during operation.

In certain embodiments and other inventive aspects, self-locating features are provided in a scroll compressor. The holding plate comprises top and bottom surfaces, and an outer peripheral edge connecting the top and bottom surfaces. The pilot ring includes a first locating surface and a second locating surface, with the first and second locating surfaces extending vertically from a body of the pilot ring.

The first locating surface extends transverse to the second locating surface. The holding plate is adapted to contact the first and second locating surfaces along the outer peripheral edge to locate the holding plate relative to the pilot ring.

The location feature may be spaced apart at the ends. For example, on the holding plate a first end region may contact the first locating surface and a second end region may contact the second locating surface, with the connection to the pilot ring intermediate thereof along a central region.

Preferably, when the self-locating feature is utilized, the first locating surface and second locating surface extending perpendicularly. Less preferred embodiments have the locating surfaces parallel or otherwise traverse.

It is another feature and inventive aspect that the same screws may also secure the holding plate to the pilot ring, but also secure the pilot ring to the crankcase. The pilot ring can be formed separately from a crankcase with a plurality of posts extending axially between the crankcase and the pilot ring (formed by both or either of the pilot ring and crankcase). Scroll bodies are positioned in the attached pilot ring and crankcase. Screws secure the pilot ring and the crank case, with at least two of said screws also securing the holding plate to the pilot ring.

The scroll compressor may include a motor contained in housing below scroll bodies, the motor having a rotational output on a drive shaft, an eccentric on the drive shaft engaging the orbiting scroll body to impart orbiting movement of the orbiting scroll body during operation of the motor.

Preferably, the scroll compressor housing comprises an outer annular shell surrounding the pilot ring, with the pilot ring not in contact with but radially spaced from an inner periphery of the outer annular shell. Instead a crankcase is mounted to the pilot ring, with the crankcase is in contact with outer annular shell.

Another inventive aspect is directed toward holding plate location. The scroll compressor comprises a housing; an orbiting scroll body in the housing, and a non-orbiting scroll body in the housing. The orbiting scroll body including a first base and a first scroll rib with the first scroll rib projecting from the first base. The non-orbiting scroll body including a second base and a second scroll rib with the second scroll rib projecting from the second base. The first and second scroll ribs mutually engage with the orbiting scroll body being movable along an orbital path about an axis relative to the a non-orbiting scroll body for compressing of fluid. A pilot ring is positioned to engage a piloted surface of the non-orbiting scroll body to limit movement of the non-orbiting scroll body in a radial direction. A holding plate secures the pilot ring and the non-orbiting scroll body to prevent rotation between the non-orbiting scroll body and the pilot ring. The holding plate is located on the pilot ring via contact with at least one shoulder on an external surface of the pilot ring.

The location maybe done in two dimensions in a further inventive feature.

According to certain embodiments for this feature, the holding plate comprises top and bottom surfaces, and an outer peripheral edge connecting the top and bottom surfaces. The pilot ring includes a first locating surface and a second locating surface provided by the at least one shoulder. The first and second locating surfaces extend vertically from a body of the pilot ring. The first locating surface extends transverse to the second locating surfaces. The holding plate is adapted to contact the first and second locating surfaces along the outer peripheral edge to locate the holding plate relative to the pilot ring.

To provide for different locating surfaces, the pilot ring preferably includes a first locating surface and a second locating surface provided by first and second shoulders respectively. The holding plate includes opposite first and second end regions and a central region, the central region located between the opposite end regions. The central region is secured to the non-orbiting scroll body and the opposite end regions secured to the pilot ring. The first end region contacts a first locating surface and the second end region contacts a second locating surface.

Preferably as in some embodiments, the first locating surface and second locating surface extend perpendicularly relative to each other.

The pilot ring includes a top surface, and the top surface may include first and second raised pads providing the first and second shoulders described above respectively. The first and second raised pads are machined to include first and second intermediate platforms upon which first and second end regions reside. Further a recessed region may reside between the first and second intermediate platforms.

Another inventive aspect is directed toward simplified assembly. The scroll compressor comprises a housing; an orbiting scroll body in the housing, and a non-orbiting scroll body in the housing. The orbiting scroll body including a first base and a first scroll rib with the first scroll rib projecting from the first base. The non-orbiting scroll body including a second base and a second scroll rib with the second scroll rib projecting from the second base. The first and second scroll ribs mutually engage with the orbiting scroll body being movable along an orbital path about an axis relative to the a non-orbiting scroll body for compressing of fluid. A pilot ring is positioned to engage a piloted surface of the non-orbiting scroll body to limit movement of the non-orbiting scroll body in a radial direction. A holding plate secures pilot ring and the non-orbiting scroll body to prevent rotation between the non-orbiting scroll body and the pilot ring. Screws (e.g. bolts or other threaded fasteners) secure the pilot ring and the crank case, with at least two of said screws also securing the holding plate to the pilot ring.

The holding plate may also be located along an external surface of the pilot ring via at least one vertically extending surface that prevents relative rotation between the holding plate and the pilot ring during torqueing of the screws.

Another inventive aspect of the present invention is directed toward a holding plate in a scroll compressor that is untwisted. The scroll compressor comprises a housing; an orbiting scroll body in the housing, and a non-orbiting scroll body in the housing. The orbiting scroll body including a first base and a first scroll rib with the first scroll rib projecting from the first base. The non-orbiting scroll body including a second base and a second scroll rib with the second scroll rib projecting from the second base. The first and second scroll ribs mutually engage with the orbiting scroll body being movable along an orbital path about an axis relative to the a non-orbiting scroll body for compressing of fluid. A pilot ring is positioned to engage a piloted surface of the non-orbiting scroll body to limit movement of the non-orbiting scroll body in a radial direction. A holding plate secures the pilot ring and the non-orbiting scroll body to prevent rotation between the non-orbiting scroll body and the pilot ring. A gap is maintained and defined between the pilot ring and the piloted surface of 1 millimeter or less for piloting movement. The holding plate includes opposite end regions and a central region, with the central region located between the opposite end regions. The central region is secured to the non-orbiting scroll body and the opposite end regions secured to the pilot ring. The holding plate comprises top and bottom surfaces and an outer peripheral edge connecting the top and bottom surfaces, wherein the top and bottom surface are untwisted being free of twisted regions.

According to additional inventive aspects, the top and bottom surfaces may extend in a common plane or parallel to the common plane throughout the opposite end regions and the central region.

Further, each end region and the central region includes a mounting hole, each mounting hole may project in a same direction through the holding plate.

According to a further feature, the bottom surface of the holding plate is placed horizontally flat upon each of the non-orbiting scroll body and the pilot ring.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
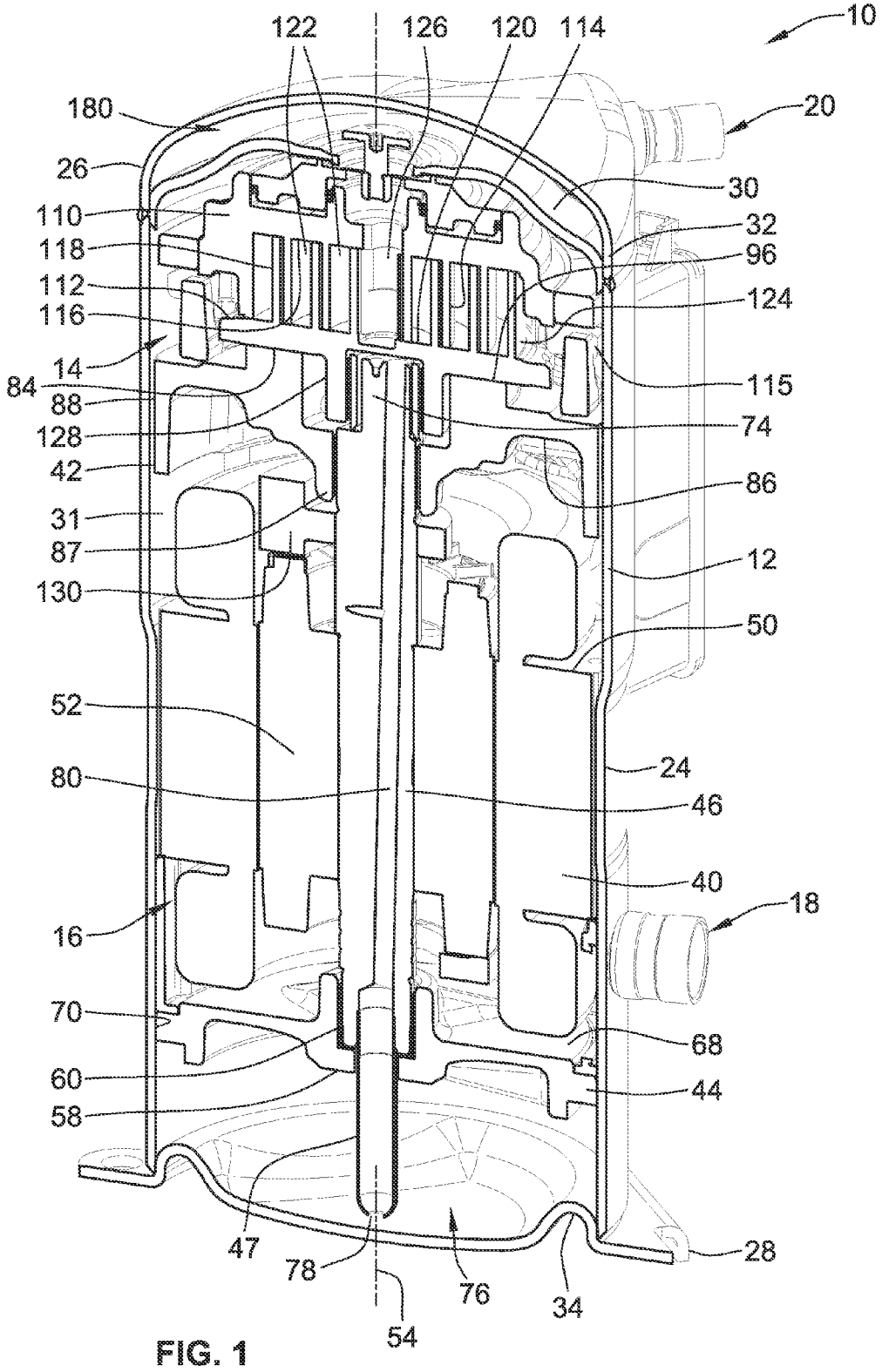
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Before turning to the holding plate 310 features of various embodiments in FIGS. 15-22, description will first be had to the details of the compliant scroll compressor assembly 10 of FIGS. 1-14 into which the holding plate 310 is incorporated. As described below, it is understood that the holding plate 310 embodiments illustrated in any of FIGS. 15-22 are applied and incorporated into to the scroll compressor assembly 10 shown in FIGS. 1-14, which are first discussed below for purposes of background. Additionally, the holding plate 310 features are useable in other compliant scroll compressor and may be substituted for existing twisted holding plates such as in U.S. Pat. No. 5,407,335, issued to Caillat et al.

An embodiment of the present invention is illustrated in the figures as the scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12. Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44. Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial" or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the drive shaft 46 has an impeller tube 47 attached at the bottom end of the drive shaft 46. In a particular embodiment, the impeller tube 47 is of a smaller diameter than the drive shaft 46, and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase".

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
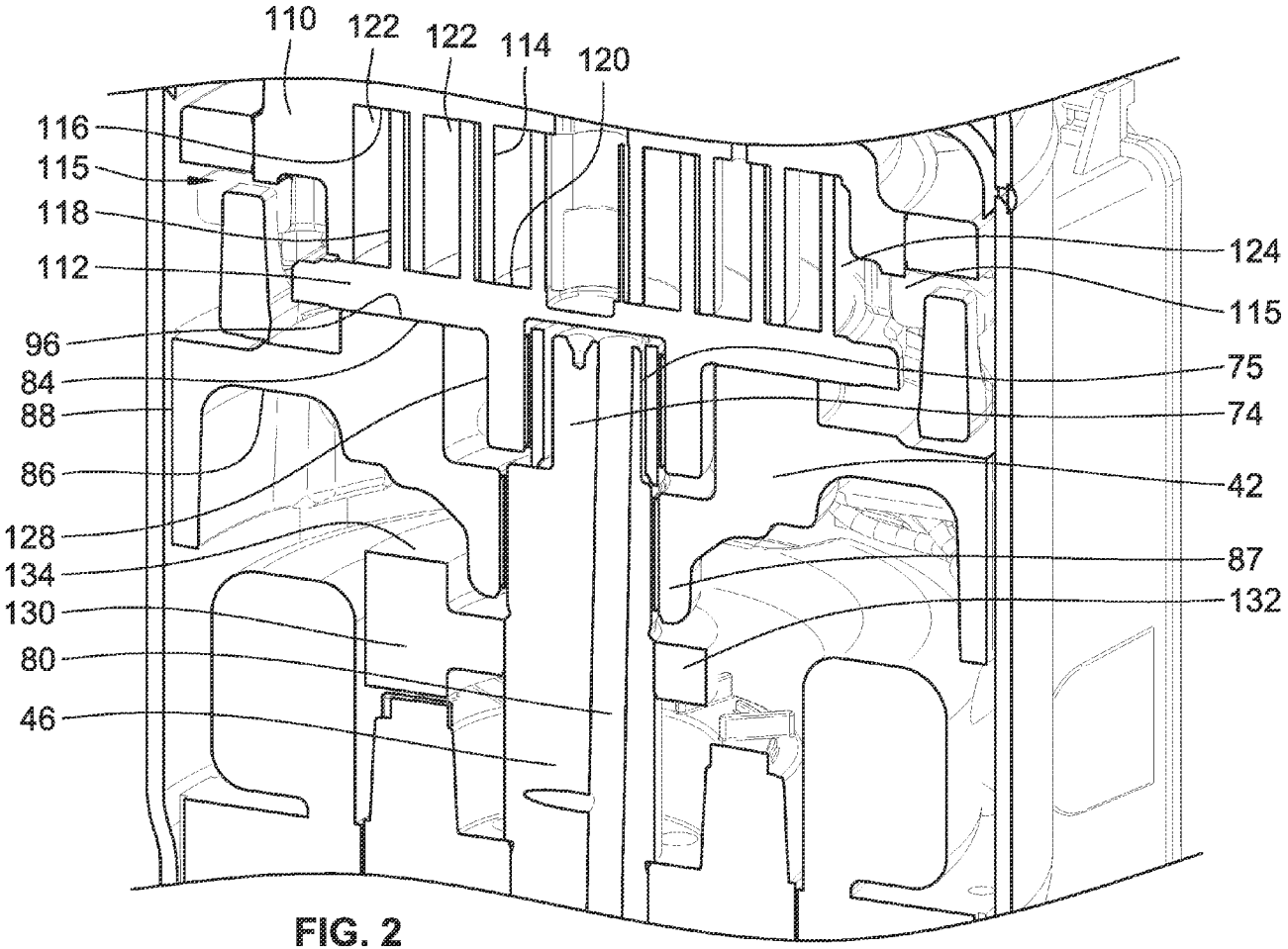
FIG. 2 is a cross-sectional isometric view of an upper portion of the scroll compressor assembly of FIG. 1.
Figure 3:
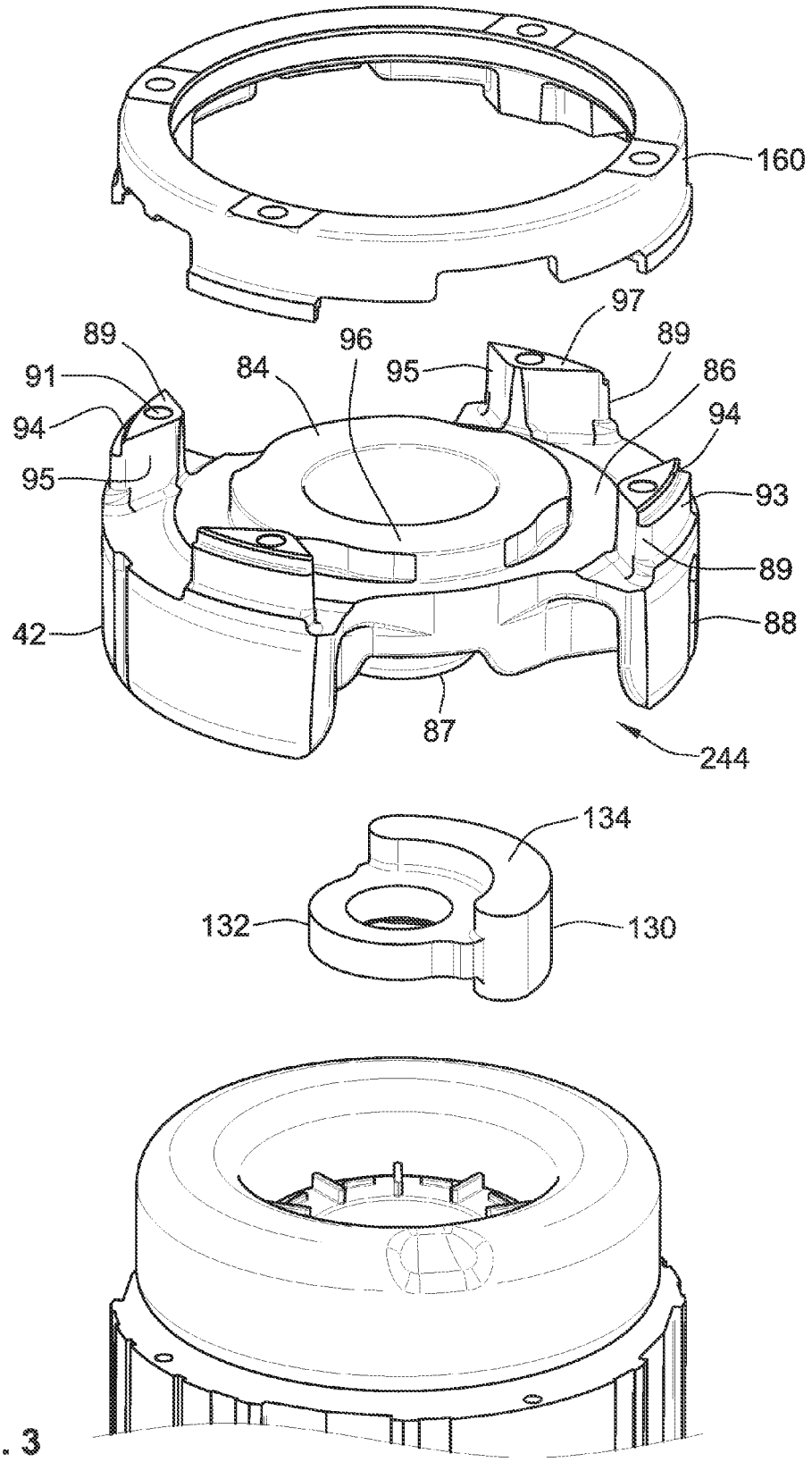
FIG. 3 is an exploded isometric view of selected components of the scroll compressor assembly of FIG. 1.

As shown in FIGS. 2 and 3, the upper bearing member, or crankcase, 42 includes a central bearing hub 87 into which the drive shaft 46 is journaled for rotation, and a thrust bearing 84 that supports the movable scroll compressor body 112. (See also FIG. 9). Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a threaded fastener. It is understood that alternate embodiments of the invention may include a crankcase with more or less than four posts, or the posts may be separate components altogether. Alternate embodiments of the invention also include those in which the posts are integral with the pilot ring instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, intermittent perimeter support surface 88 abuts the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

Figure 13:
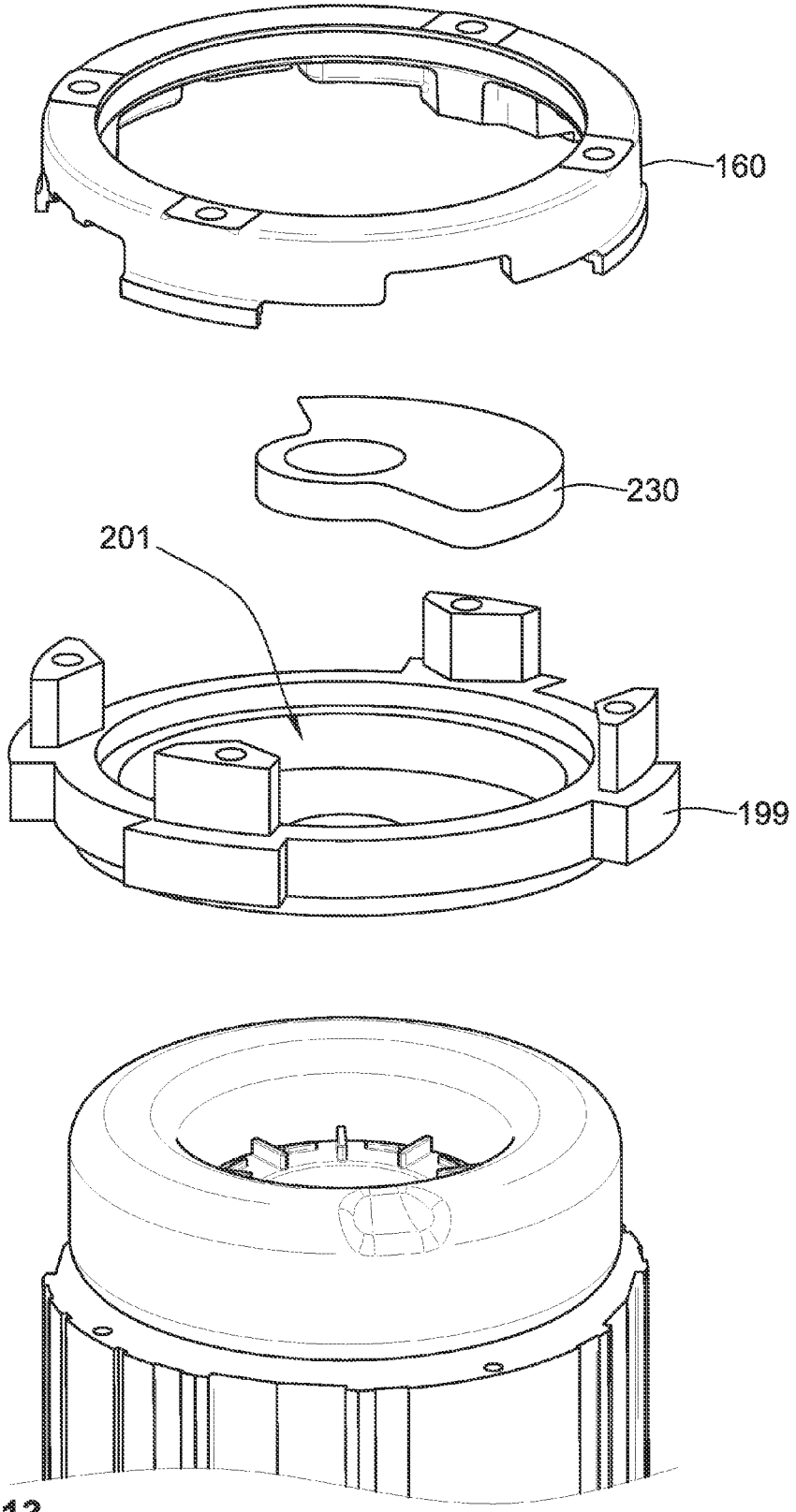
FIG. 13 is an exploded isometric view of selected components for an alternate embodiment of the scroll compressor assembly.
Figure 14:
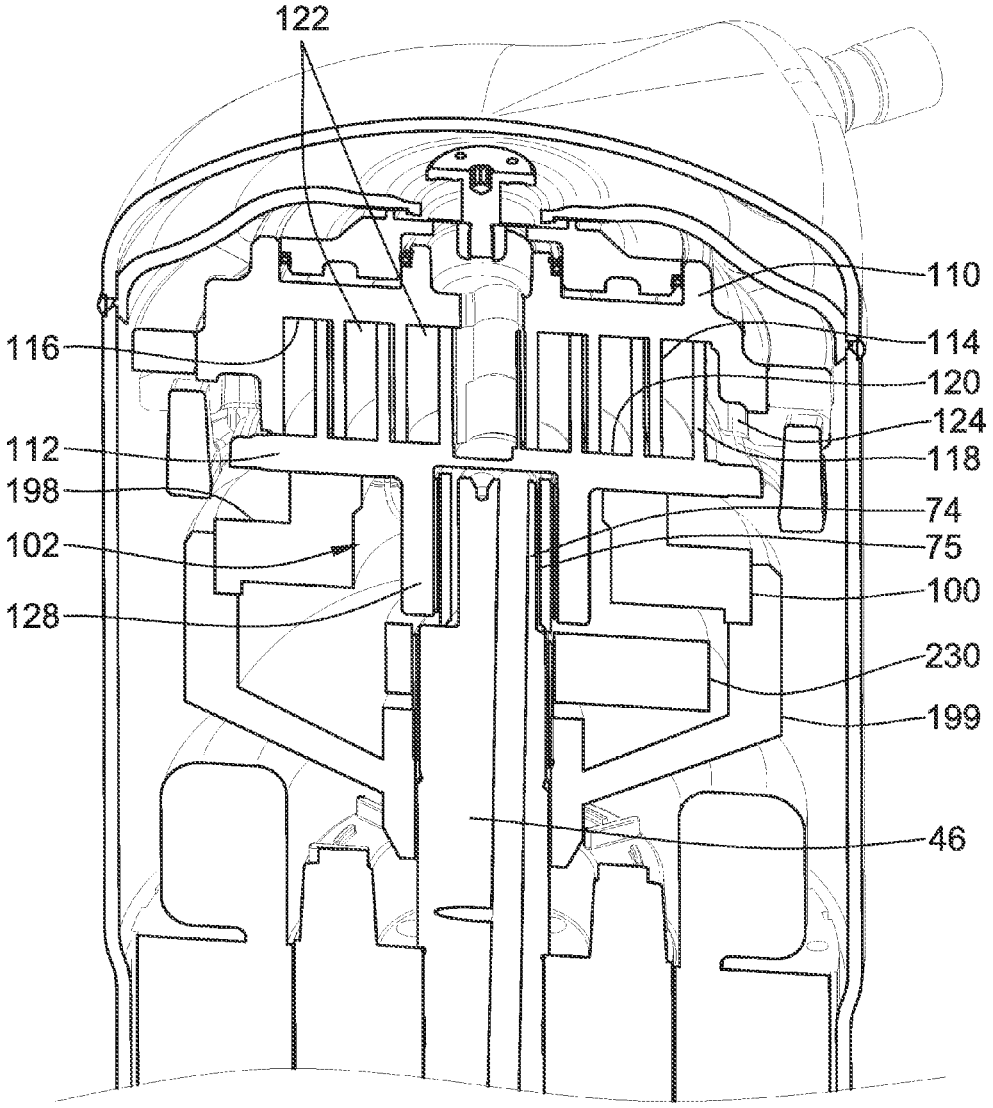
FIG. 14 is a cross-sectional isometric view of a portion of a scroll compressor assembly, constructed in accordance with an embodiment of the invention.

The upper bearing member or crankcase 42 also provides axial thrust support to the movable scroll compressor body 112 through a bearing support via an axial thrust surface 96 of thrust bearing 84. While, as shown FIGS. 1-3, the crankcase 42 may be integrally provided by a single unitary component, FIGS. 13 and 14 show an alternate embodiment in which the axial thrust support is provided by a separate collar member 198 that is assembled and concentrically located within the upper portion of the upper bearing member 199 along stepped annular interface 100. The collar member 198 defines a central opening 102 that is a size large enough to clear a cylindrical bushing drive hub 128 of the movable scroll compressor body 112 in addition to the eccentric offset drive section 74, and allow for orbital eccentric movement thereof.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective surfaces of bases 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54. Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or cancelling out inertial forces.

Figure 4:
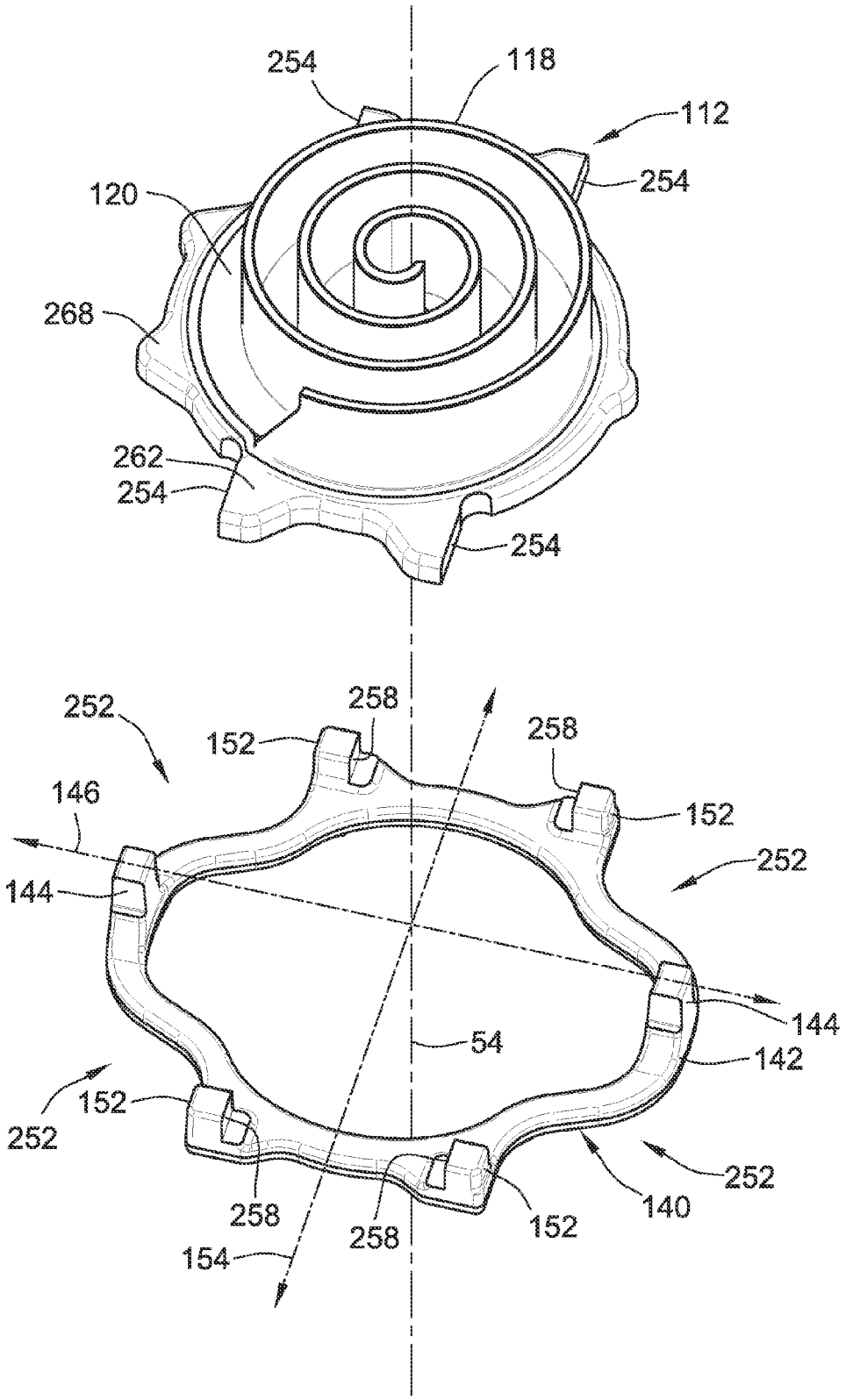
FIG. 4 is a perspective view of an exemplary key coupling and movable scroll compressor body, according to an embodiment of the invention.
Figure 7:
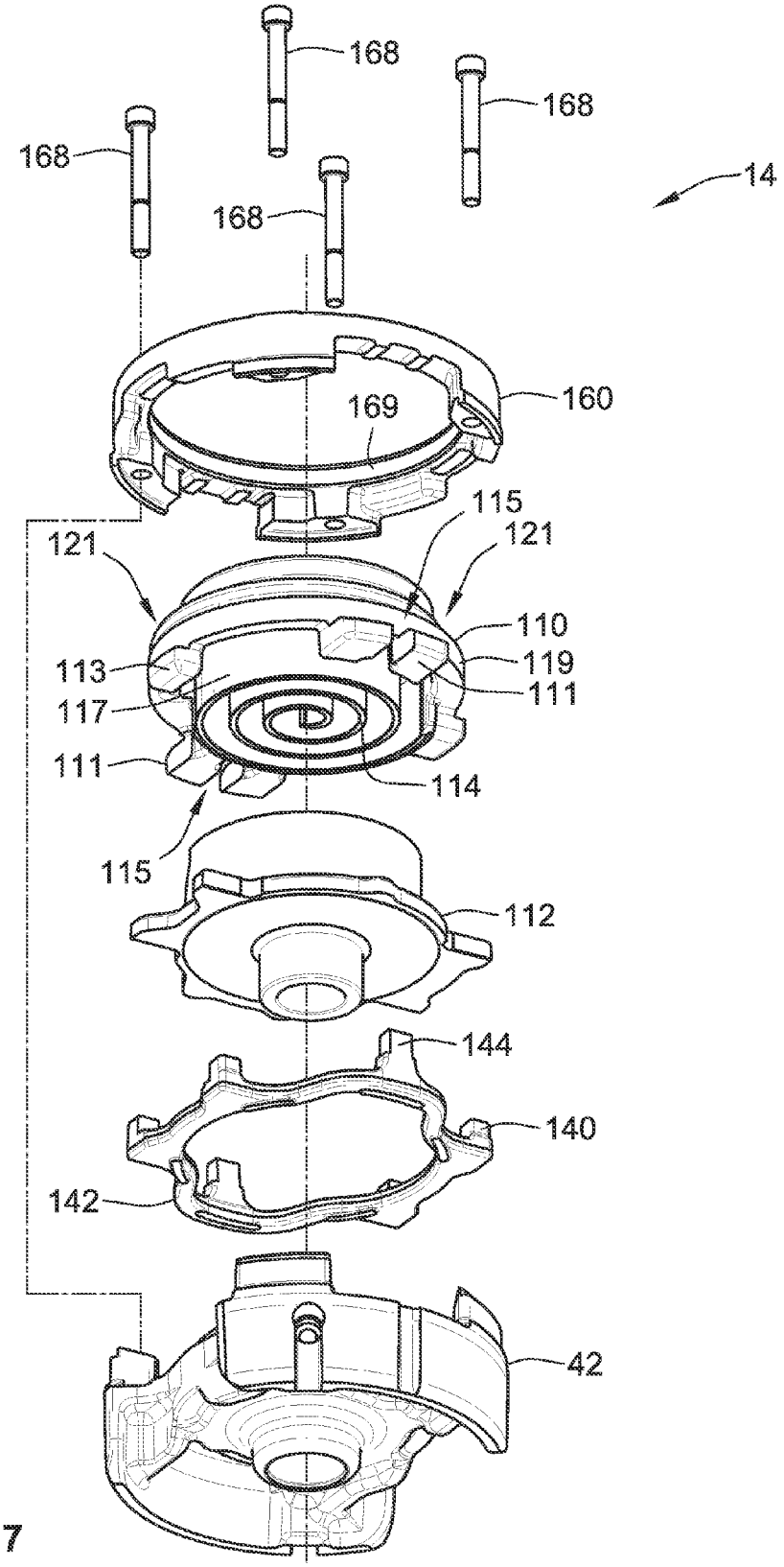
FIG. 7 is an exploded isometric view of the pilot ring, crankcase, key coupler and scroll compressor bodies, according to an embodiment of the invention.

With reference to FIGS. 4 and 7, the guiding movement of the scroll compressor 14 can be seen. To guide the orbital movement of the movable scroll compressor body 112 relative to the fixed scroll compressor body 110, an appropriate key coupling 140 may be provided. Keyed couplings 140 are often referred to in the scroll compressor art as an "Oldham Coupling." In this embodiment, the key coupling 140 includes an outer ring body 142 and includes two axially-projecting first keys 144 that are linearly spaced along a first lateral axis 146 and that slide closely and linearly within two respective keyway tracks or slots 115 (shown in FIGS. 1 and 2) of the fixed scroll compressor body that are linearly spaced and aligned along the first axis 146 as well. The slots 115 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project axially (i.e., parallel to central axis 54) from the ring body 142 of the key coupling 140. This control of movement along the first lateral axis 146 guides part of the overall orbital path of the movable scroll compressor body 112.

Referring specifically to FIG. 4, the key coupling 140 includes four axially-projecting second keys 152 in which opposed pairs of the second keys 152 are linearly aligned substantially parallel relative to a second transverse lateral axis 154 that is perpendicular to the first lateral axis 146. There are two sets of the second keys 152 that act cooperatively to receive projecting sliding guide portions 254 that project from the base 120 on opposite sides of the movable scroll compressor body 112. The guide portions 254 linearly engage and are guided for linear movement along the second transverse lateral axis 154 by virtue of sliding linear guiding movement of the guide portions 254 along sets of the second keys 152.

It can be seen in FIG. 4 that four sliding contact surfaces 258 are provided on the four axially-projecting second keys 152 of the key coupling 140. As shown, each of the sliding contact surfaces 258 is contained in its own separate quadrant 252 (the quadrants 252 being defined by the mutually perpendicular lateral axes 146, 154). As shown, cooperating pairs of the sliding contact surfaces 258 are provided on each side of the first lateral axis 146.

By virtue of the key coupling 140, the movable scroll compressor body 112 has movement restrained relative to the fixed scroll compressor body 110 along the first lateral axis 146 and second transverse lateral axis 154. This results in the prevention of relative rotation of the movable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the movable scroll 112 along the first lateral axis 146 therewith. Additionally, the movable scroll compressor body can independently move relative to the key coupling 140 along the second transverse lateral axis 154 by virtue of relative sliding movement afforded by the guide portions 254 which are received and slide between the second keys 152. By allowing for simultaneous movement in two mutually perpendicular axes 146, 154, the eccentric motion that is afforded by the eccentric offset drive section 74 of the drive shaft 46 upon the cylindrical bushing drive hub 128 of the movable scroll compressor body 112 is translated into an orbital path movement of the movable scroll compressor body 112 relative to the fixed scroll compressor body 110.

To carry axial thrust loads, the movable scroll compressor body 112 also includes flange portions 268 projecting in a direction perpendicular relative to the guiding flange portions 262 (e.g. along the first lateral axis 146). These additional flange portions 268 are preferably contained within the diametrical boundary created by the guide flange portions 262 so as to best realize the size reduction benefits. Yet a further advantage of this design is that the sliding faces 254 of the movable scroll compressor body 112 are open and not contained within a slot. This is advantageous during manufacture in that it affords subsequent machining operations such as finishing milling for creating the desirable tolerances and running clearances as may be desired.

Figure 5:
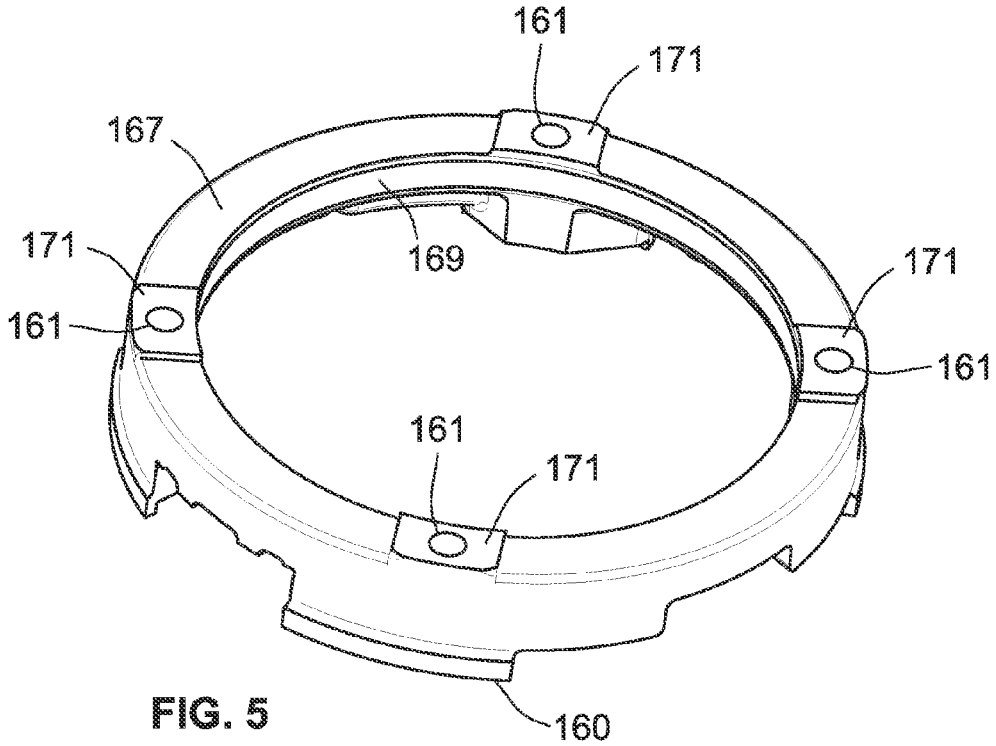
FIG. 5 is a top isometric view of the pilot ring, constructed in accordance with an embodiment of the invention.

Generally, scroll compressors with movable and fixed scroll compressor bodies require some type of restraint for the fixed scroll compressor body 110 which restricts the radial movement and rotational movement but which allows some degree of axial movement so that the fixed and movable scroll compressor bodies 110, 112 are not damaged during operation of the scroll compressor 14. In embodiments of the invention, that restraint is provided by a pilot ring 160, as shown in FIGS. 5-9. FIG. 5 shows the top side of pilot ring 160, constructed in accordance with an embodiment of the invention. The pilot ring 160 has a top surface 167, a cylindrical outer perimeter surface 178, and a cylindrical first inner wall 169. The pilot ring 160 of FIG. 5 includes four holes 161 through which fasteners, such as threaded bolts, may be inserted to allow for attachment of the pilot ring 160 to the crankcase 42. In a particular embodiment, the pilot ring 160 has axially-raised portions 171 (also referred to as mounting bosses) where the holes 161 are located. One of skill in the art will recognize that alternate embodiments of the pilot ring may have greater or fewer than four holes for fasteners. The pilot ring 160 may be a machined metal casting, or, in alternate embodiments, a machined component of iron, steel, aluminum, or some other similarly suitable material.

Figure 6:
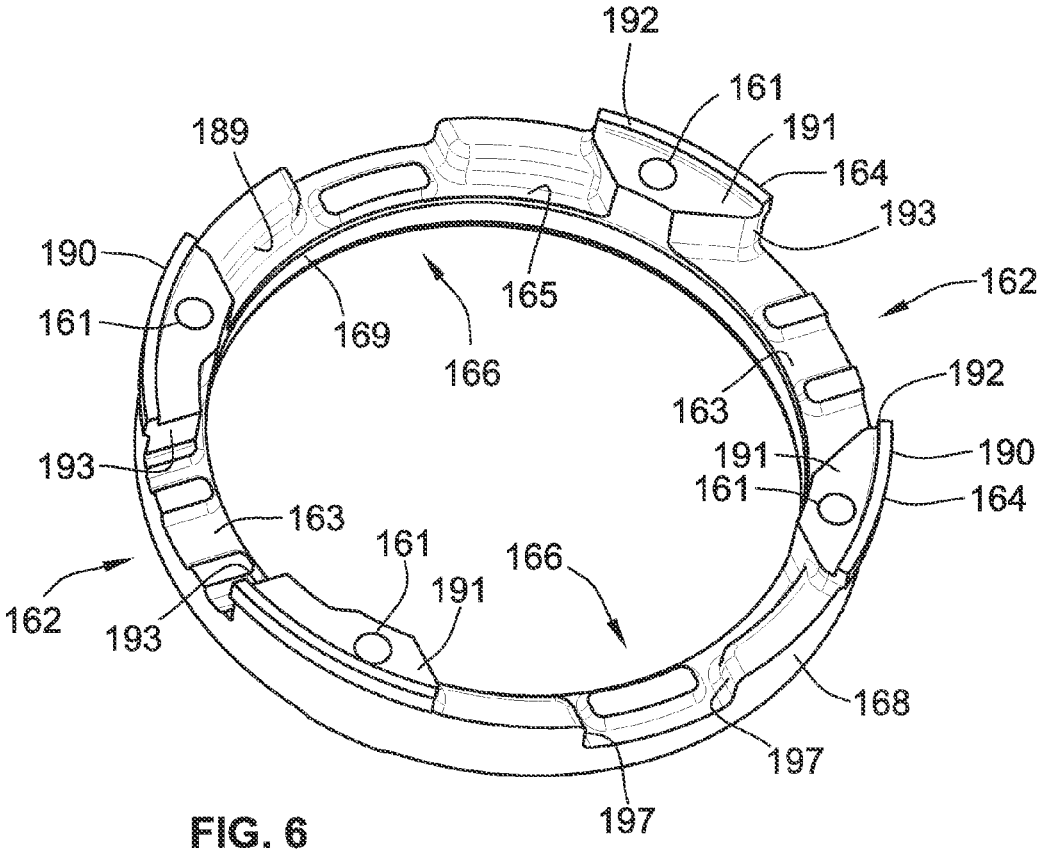
FIG. 6 is a bottom isometric view of the pilot ring of FIG. 5.

FIG. 6 shows a bottom view of the pilot ring 160 showing the four holes 161 along with two slots 162 formed into the pilot ring 160. In the embodiment of FIG. 6, the slots 162 are spaced approximately 180 degrees apart on the pilot ring 160. Each slot 162 is bounded on two sides by axially-extending side walls 193. As shown in FIG. 6, the bottom side of the pilot ring 160 includes a base portion 163 which is continuous around the entire circumference of the pilot ring 160 forming a complete cylinder. But on each side of the two slots 162, there is a semi-circular stepped portion 164 which covers some of the base portion 163 such that a ledge 165 is formed on the part of the pilot ring 160 radially inward of each semi-circular stepped portion 164. The inner-most diameter of the ledge 165 is bounded by the first inner wall 169.

A second inner wall 189 runs along the inner diameter of each semi-circular stepped portion 164. Each semi-circular stepped portion 164 further includes a bottom surface 191, a notched section 166, and a chamfered lip 190. In the embodiment of FIG. 6, each chamfered lip 190 runs the entire length of the semi-circular stepped portion 164 making the chamfered lip 190 semi-circular as well. Each chamfered lip 190 is located on the radially-outermost edge of the bottom surface 191, and extends axially from the bottom surface 191. Further, each chamfered lip 190 includes a chamfered edge surface 192 on an inner radius of the chamfered lip 190. When assembled, the chamfered edge surface 192 is configured to mate with the chamfered edge 94 on each post 89 of the crankcase. The mating of these chamfered surfaces allows for an easier, better-fitting assembly, and reduces the likelihood of assembly problems due to manufacturing tolerances.

In the embodiment of FIG. 6, the notched sections 166 are approximately 180 degrees apart on the pilot ring 160, and each is about midway between the two ends of the semi-circular stepped portion 164. The notched sections 166 are bounded on the sides by sidewall sections 197. Notched sections 166 thus extend radially and axially into the semi-circular stepped portion 164 of the pilot ring 160.

FIG. 7 shows an exploded view of the scroll compressor 14 assembly, according to an embodiment of the invention. The top-most component shown is the pilot ring 160 which is adapted to fit over the top of the fixed scroll compressor body 110. The fixed scroll compressor body 110 has a pair of first radially-outward projecting limit tabs 111. In the embodiment of FIG. 7, one of the pair of first radially-outward projecting limit tabs 111 is attached to an outermost perimeter surface 117 of the first scroll rib 114, while the other of the pair of first radially-outward projecting limit tabs 111 is attached to a perimeter portion of the fixed scroll compressor body 110 below a perimeter surface 119. In further embodiments, the pair of first radially-outward projecting limit tabs 111 are spaced approximately 180 degrees apart. Additionally, in particular embodiments, each of the pair of first radially-outward-projecting limit tabs 111 has a slot 115 therein. In particular embodiments, the slot 115 may be a U-shaped opening, a rectangular-shaped opening, or have some other suitable shape.

The fixed scroll compressor body 110 also has a pair of second radially-outward projecting limit tabs 113, which, in this embodiment, are spaced approximately 180 degrees apart. In certain embodiments, the second radially-outward projecting limit tabs 113 share a common plane with the first radially-outward-projecting limit tabs 111. Additionally, in the embodiment of FIG. 7, one of the pair of second radially-outward projecting limit tabs 113 is attached to an outermost perimeter surface 117 of the first scroll rib 114, while the other of the pair of second radially-outward projecting limit tabs 113 is attached to a perimeter portion of the fixed scroll compressor body 110 below the perimeter surface 119. The movable scroll compressor body 112 is configured to be held within the keys of the key coupling 140 and mates with the fixed scroll compressor body 110. As explained above, the key coupling 140 has two axially-projecting first keys 144, which are configured to be received within the slots 115 in the first radially-outward-projecting limit tabs 111. When assembled, the key coupling 140, fixed and movable scroll compressor bodies 110, 112 are all configured to be disposed within crankcase 42, which can be attached the to the pilot ring 160 by the threaded bolts 168 shown above the pilot ring 160.

Referring still to FIG. 7, the fixed scroll compressor body 110 includes plate-like base 116 (see FIG. 14) and the perimeter surface 119 spaced axially from the plate-like base 116. In a particular embodiment, the entirety of the perimeter surface 119 surrounds the first scroll rib 114 of the fixed scroll compressor body 110, and is configured to abut the first inner wall 169 of the pilot ring 160, though embodiments are contemplated in which the engagement of the pilot ring and fixed scroll compressor body involve less than the entire circumference. In particular embodiments of the invention, the first inner wall 169 is precisely toleranced to fit snugly around the perimeter surface 119 to thereby limit radial movement of the first scroll compressor body 110, and thus provide radial restraint for the first scroll compressor body 110. The plate-like base 116 further includes a radially-extending top surface 121 that extends radially inward from the perimeter surface 119. The radially-extending top surface 121 extends radially inward towards a step-shaped portion 123 (see FIG. 8). From this step-shaped portion 123, a cylindrical inner hub region 172 and peripheral rim 174 extend axially (i.e., parallel to central axis 54, when assembled into scroll compressor assembly 10).

Figure 8:
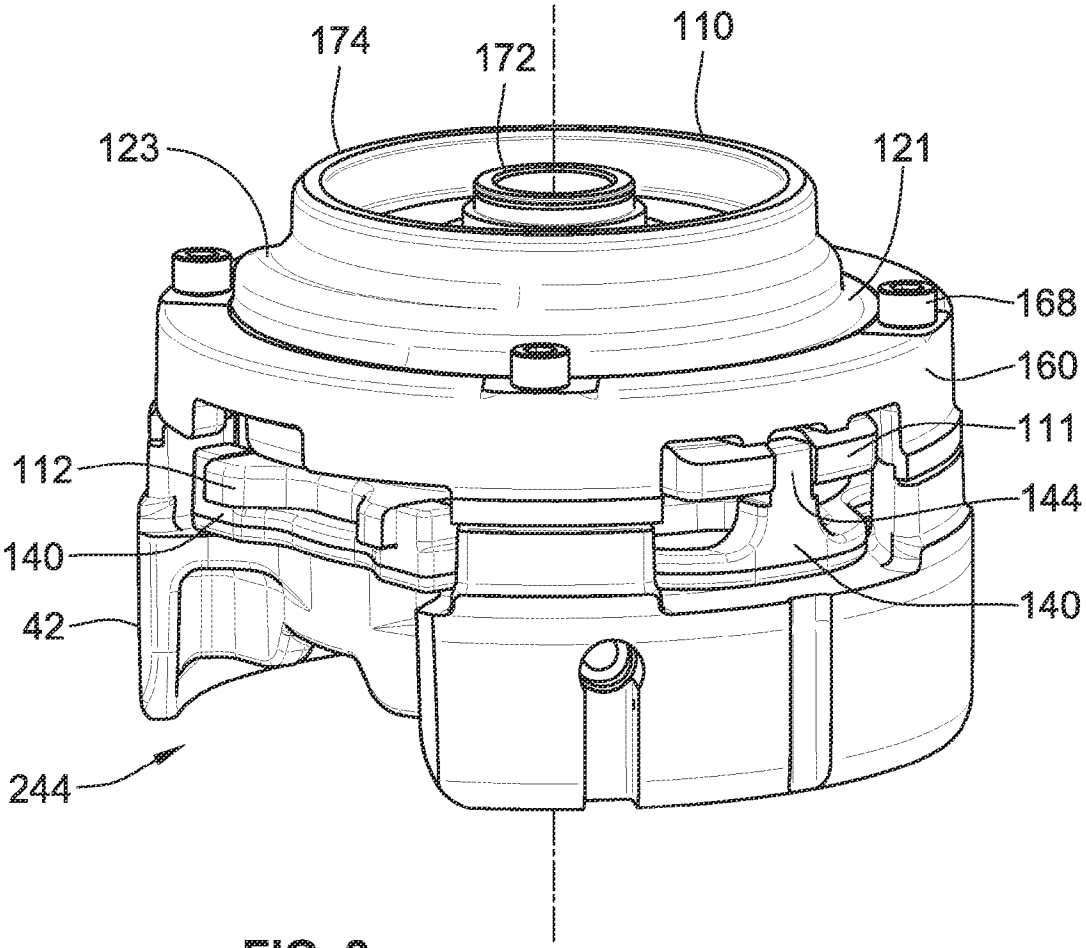
FIG. 8 is a isometric view of the components of FIG. 7 shown assembled.

FIG. 8 shows the components of FIG. 7 fully assembled. The pilot ring 160 securely holds the fixed scroll compressor body 110 in place with respect to the movable scroll compressor body 112 and key coupling 140. The threaded bolts 168 attach the pilot ring 160 and crankcase 42. As can be seen from FIG. 8, each of the pair of first radially-outward projecting limit tabs 111 is positioned in its respective slot 162 of the pilot ring 160. As stated above, the slots 115 in the pair of first radially-outward projecting limit tabs 111 are configured to receive the two axially-projecting first keys 144. In this manner, the pair of first radially-outward projecting limit tabs 111 engage the side portion 193 of the pilot ring slots 162 to prevent rotation of the fixed scroll compressor body 110, while the key coupling first keys 144 engage a side portion of the slot 115 to prevent rotations of the key coupling 140. Limit tabs 111 also provide additional (to limit tabs 113) axial limit stops.

Though not visible in the view of FIG. 8, each of the pair of second radially-outward projecting limit tabs 113 (see FIG. 7) is nested in its respective notched section 166 of the pilot ring 160 to constrain axial movement of the fixed scroll compressor body 110 thereby defining a limit to the available range of axial movement of the fixed scroll compressor body 110. The pilot ring notched sections 166 are configured to provide some clearance between the pilot ring 160 and the pair of second radially-outward projecting limit tabs 113 to provide for axial restraint between the fixed and movable scroll compressor bodies 110, 112 during scroll compressor operation. However, the radially-outward projecting limit tabs 113 and notched sections 166 also keep the extent of axial movement of the fixed scroll compressor body 110 to within an acceptable range.

It should be noted that "limit tab" is used generically to refer to either or both of the radially-outward projecting limit tabs 111, 113. Embodiments of the invention may include just one of the pairs of the radially-outward projecting limit tabs, or possibly just one radially-outward projecting limit tab, and particular claims herein may encompass these various alternative embodiments As illustrated in FIG. 8, the crankcase 42 and pilot ring 160 design allow for the key coupling 140, and the fixed and movable scroll compressor bodies 110, 112 to be of a diameter that is approximately equal to that of the crankcase 42 and pilot ring 160. As shown in FIG. 1, the diameters of these components may abut or nearly abut the inner surface of the outer housing 12, and, as such, the diameters of these components is approximately equal to the inner diameter of the outer housing 12. It is also evident that when the key coupling 140 is as large as the surrounding compressor outer housing 12 allows, this in turn provides more room inside the key coupling 140 for a larger thrust bearing which in turn allows a larger scroll set. This maximizes the scroll compressor 14 displacement available within a given diameter outer housing 12, and thus uses less material at less cost than in conventional scroll compressor designs.

It is contemplated that the embodiments of FIGS. 7 and 8 in which the first scroll compressor body 110 includes four radially-outward projecting limit tabs 111, 113, these limit tabs 111, 113 could provide radial restraint of the first scroll compressor body 110, as well as axial and rotation restraint. For example, radially-outward projecting limit tabs 113 could be configured to fit snugly with notched sections 166 such that these limit tabs 113 sufficiently limit radial movement of the first scroll compressor body 110 along first lateral axis 146. Additionally, each of the radially-outward-projecting limit tabs 111 could have a notched portion configured to abut the portion of the first inner wall 169 adjacent the slots 162 of the pilot ring 160 to provide radial restraint along second lateral axis 154. While this approach could potentially require maintaining a certain tolerance for the limit tabs 111, 113 or the notched section 166 and slots 162, in these instances, there would be no need to precisely tolerance the entire first inner wall 169 of the pilot ring 160, as this particular feature would not be needed to provide radial restraint of the first scroll compressor body 110.

Figure 11:
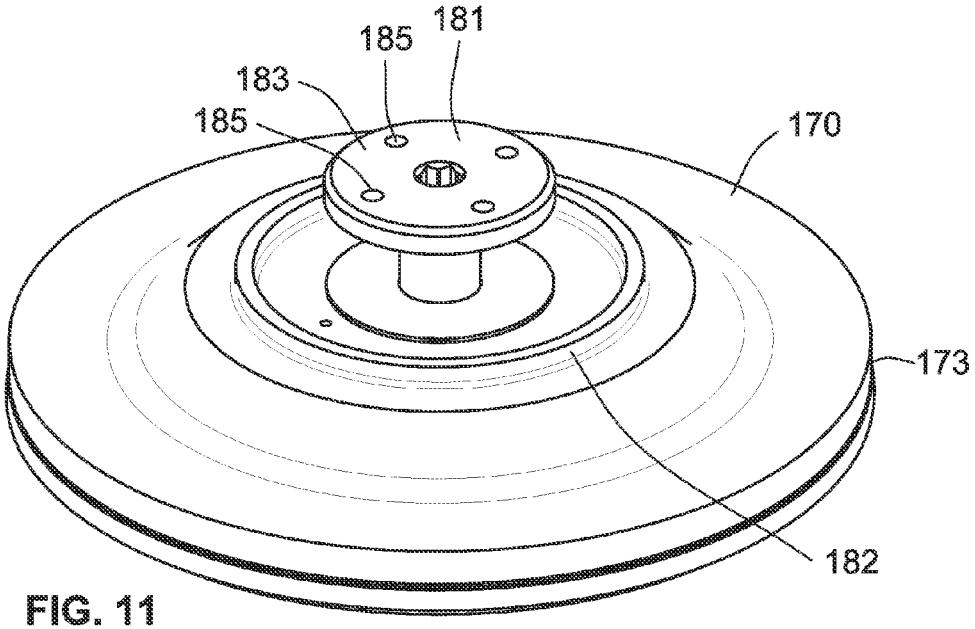
FIG. 11 is a top isometric view of the floating seal, according to an embodiment of the invention.
Figure 12:
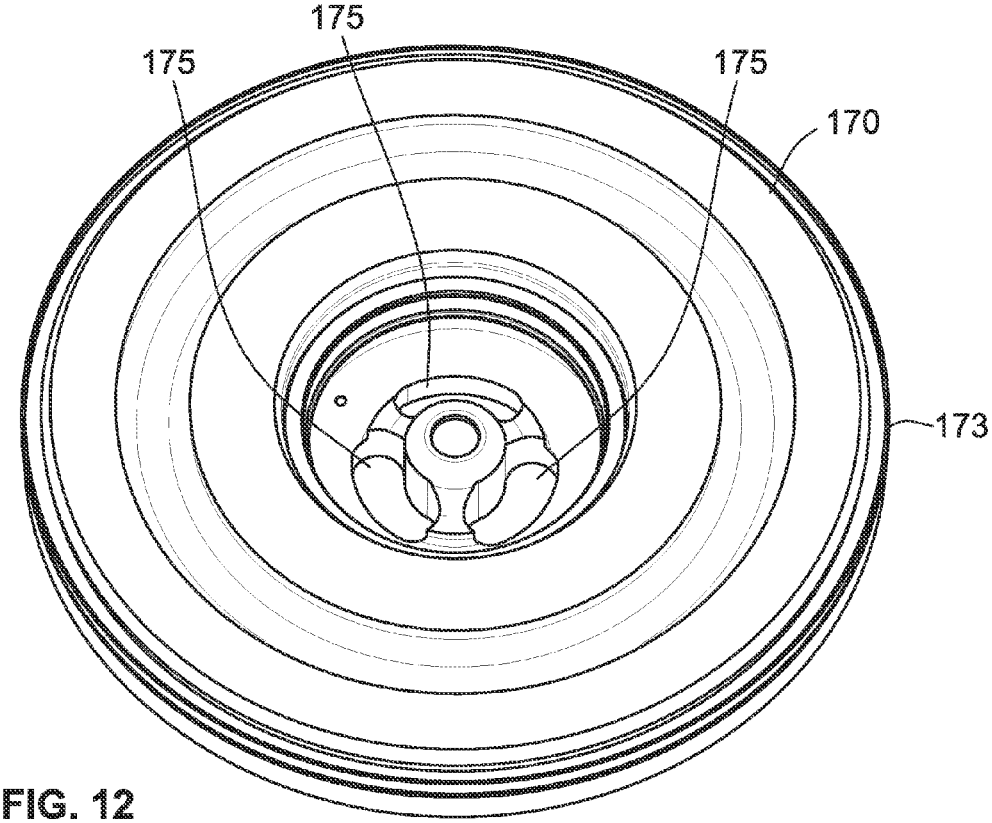
FIG. 12 is a bottom isometric view of the floating seal of FIG. 11.

With reference to FIGS. 9-12, the upper side (e.g. the side opposite the scroll rib) of the fixed scroll 110 supports a floating seal 170 above which is disposed the separator plate 30. In the embodiment shown, to accommodate the floating seal 170, the upper side of the fixed scroll compressor body 110 includes an annular and, more specifically, the cylindrical inner hub region 172, and the peripheral rim 174 spaced radially outward from the inner hub region 172. The inner hub region 172 and the peripheral rim 174 are connected by a radially-extending disc region 176 of the base 116. As shown in FIG. 11, the underside of the floating seal 170 has circular cutout adapted to accommodate the inner hub region 172 of the fixed scroll compressor body 110. Further, as can be seen from FIGS. 9 and 10, the perimeter wall 173 of the floating seal is adapted to fit somewhat snugly inside the peripheral rim 174. In this manner, the fixed scroll compressor body 110 centers and holds the floating seal 170 with respect to the central axis 54.

Figure 9:
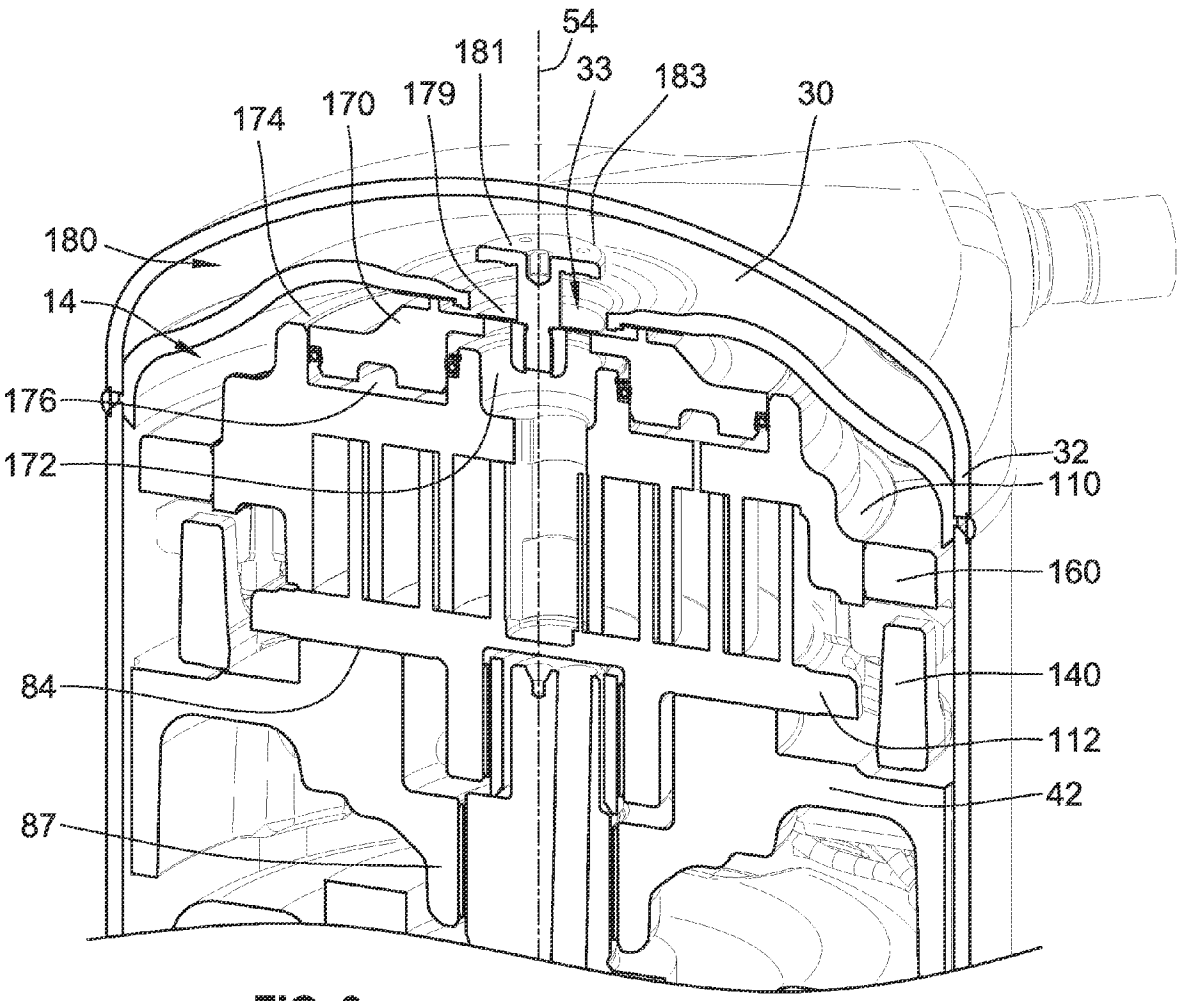
FIG. 9 is a cross-sectional isometric view of the components in the top end section of the outer housing, according to an embodiment of the invention.
Figure 10:
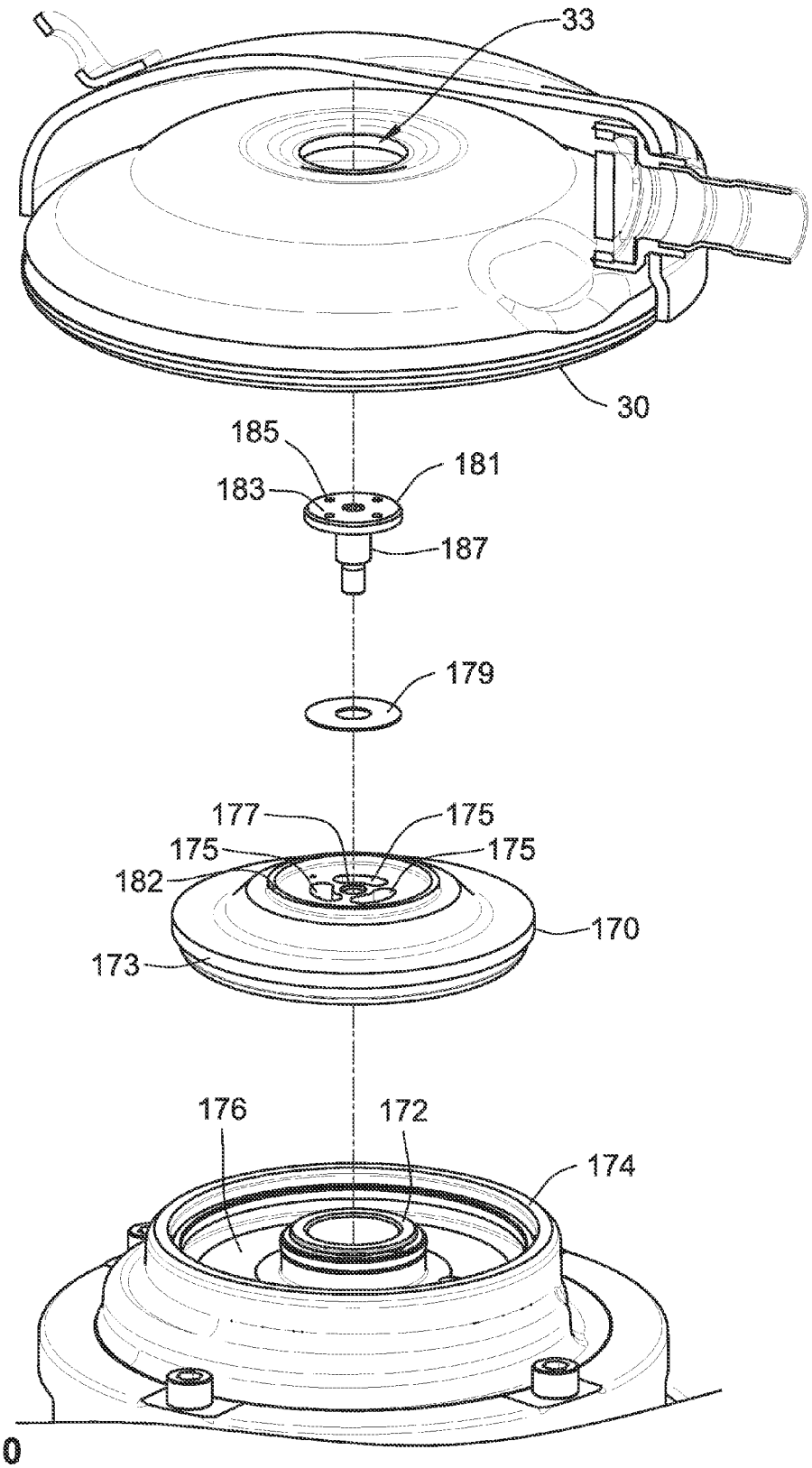
FIG. 10 is an exploded isometric view of the components of FIG. 9.

In a particular embodiment of the invention, a central region of the floating seal 170 includes a plurality of openings 175. In the embodiment shown, one of the plurality of openings 175 is centered on the central axis 54. That central opening 177 is adapted to receive a rod 181 which is affixed to the floating seal 170. As shown in FIGS. 9 through 12, a ring valve 179 is assembled to the floating seal 170 such that the ring valve 179 covers the plurality of openings 175 in the floating seal 170, except for the central opening 177 through which the rod 181 is inserted. The rod 181 includes an upper flange 183 with a plurality of openings 185 therethrough, and a stem 187. As can be seen in FIG. 9, the separator plate 30 has a center hole 33. The upper flange 183 of rod 181 is adapted to pass through the center hole 33, while the stem 187 is inserted through central opening 177. The ring valve 179 slides up and down the rod 181 as needed to prevent back flow from a high-pressure chamber 180. With this arrangement, the combination of the separator plate 30 and the fixed scroll compressor body 110 serve to separate the high pressure chamber 180 from a lower pressure region within the outer housing 12. Rod 181 guides and limits the motion of the ring valve 179. While the separator plate 30 is shown as engaging and constrained radially within the cylindrical side wall region 32 of the top end housing section 26, the separator plate 30 could alternatively be cylindrically located and axially supported by some portion or component of the scroll compressor 14.

In certain embodiments, when the floating seal 170 is installed in the space between the inner hub region 172 and the peripheral rim 174, the space beneath the floating seal 170 is pressurized by a vent hole (not shown) drilled through the fixed scroll compressor body 110 to chamber 122 (shown in FIG. 2). This pushes the floating seal 170 up against the separator plate 30 (shown in FIG. 9). A circular rib 182 presses against the underside of the separator plate 30 forming a seal between high-pressure discharge gas and low-pressure suction gas.

While the separator plate 30 could be a stamped steel component, it could also be constructed as a cast and/or machined member (and may be made from steel or aluminum) to provide the ability and structural features necessary to operate in proximity to the high-pressure refrigerant gases output by the scroll compressor 14. By casting or machining the separator plate 30 in this manner, heavy stamping of such components can be avoided.

During operation, the scroll compressor assembly 10 is operable to receive low-pressure refrigerant at the housing inlet port 18 and compress the refrigerant for delivery to the high-pressure chamber 180 where it can be output through the housing outlet port 20. This allows the low-pressure refrigerant to flow across the electrical motor assembly 40 and thereby cool and carry away from the electrical motor assembly 40 heat which can be generated by operation of the motor. Low-pressure refrigerant can then pass longitudinally through the electrical motor assembly 40, around and through void spaces therein toward the scroll compressor 14. The low-pressure refrigerant fills the chamber 31 formed between the electrical motor assembly 40 and the outer housing 12. From the chamber 31, the low-pressure refrigerant can pass through the upper bearing member or crankcase 42 through the plurality of spaces 244 that are defined by recesses around the circumference of the crankcase 42 in order to create gaps between the crankcase 42 and the outer housing 12. The plurality of spaces 244 may be angularly spaced relative to the circumference of the crankcase 42.

After passing through the plurality of spaces 244 in the crankcase 42, the low-pressure refrigerant then enters the intake area 124 between the fixed and movable scroll compressor bodies 110, 112. From the intake area 124, the low-pressure refrigerant enters between the scroll ribs 114, 118 on opposite sides (one intake on each side of the fixed scroll compressor body 110) and is progressively compressed through chambers 122 until the refrigerant reaches its maximum compressed state at the compression outlet 126 from which it subsequently passes through the floating seal 170 via the plurality of openings 175 and into the high-pressure chamber 180. From this high-pressure chamber 180, high-pressure compressed refrigerant then flows from the scroll compressor assembly 10 through the housing outlet port 20.

FIGS. 13 and 14 illustrate an alternate embodiment of the invention. Instead of a crankcase 42 formed as a single piece, FIGS. 13 and 14 show an upper bearing member or crankcase 199 combined with a separate collar member 198 (see FIG. 14 for collar member 198), which provides axial thrust support for the scroll compressor 14. In a particular embodiment, the collar member 198 (FIG. 14) is assembled into the upper portion of the upper bearing member or crankcase 199 along stepped annular interface 100. Having a separate collar member 198 allows for a counterweight 230 to be assembled within the crankcase 199, which is attached to the pilot ring 160. This allows for a more compact assembly than described in the previous embodiment where the counterweight 130 was located outside of the crankcase 42.

As is evident from the exploded view of FIG. 13 and as stated above, the pilot ring 160 can be attached to the upper bearing member or crankcase 199 via a plurality of threaded fasteners to the upper bearing member 199 in the same manner that it was attached to crankcase 42 in the previous embodiment. The flattened profile of the counterweight 230 allows for it to be nested within an interior portion 201 of the upper bearing member 199 without interfering with the collar member 198, the key coupling 140, or the movable scroll compressor body 112.

Figure 15:
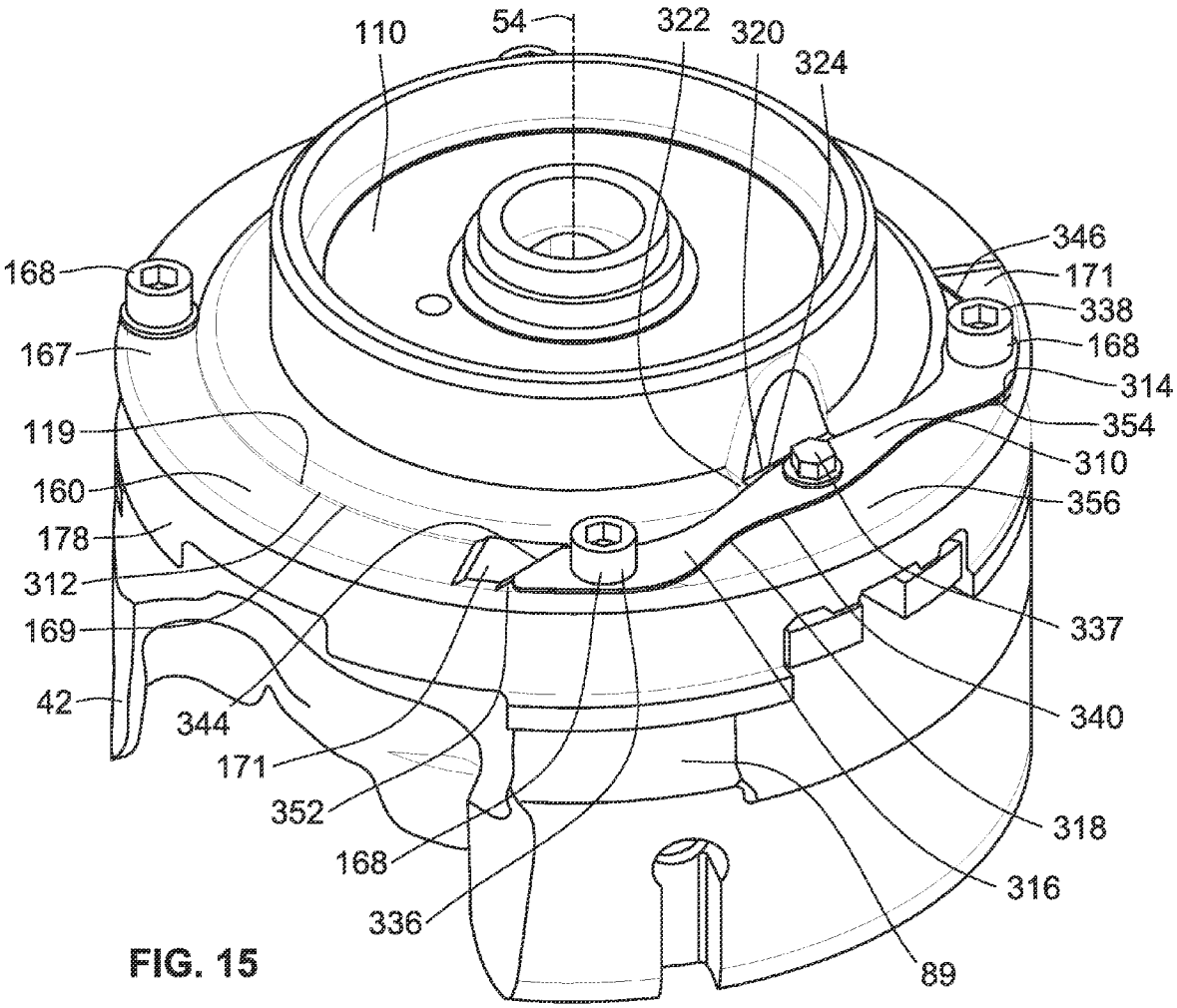
FIG. 15 is an isometric view for certain components including a non-orbiting (fixed) scroll, assembled with pilot ring, crankcase, and holding plate assembly that is usable and employed in the scroll compressor assembly shown in the prior Figures.
Figure 16:
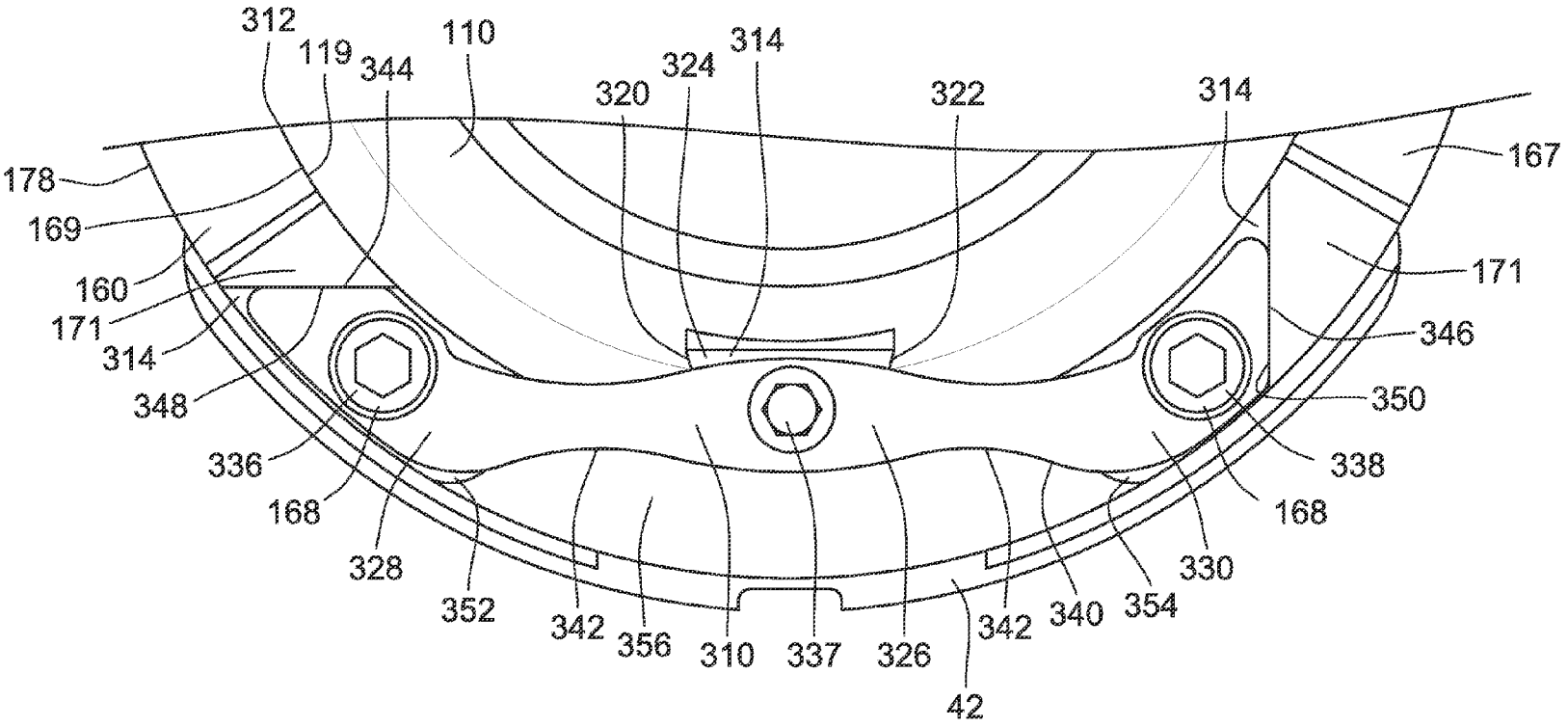
FIG. 16 is a top view of the assembly shown in FIG. 15.
Figure 17:
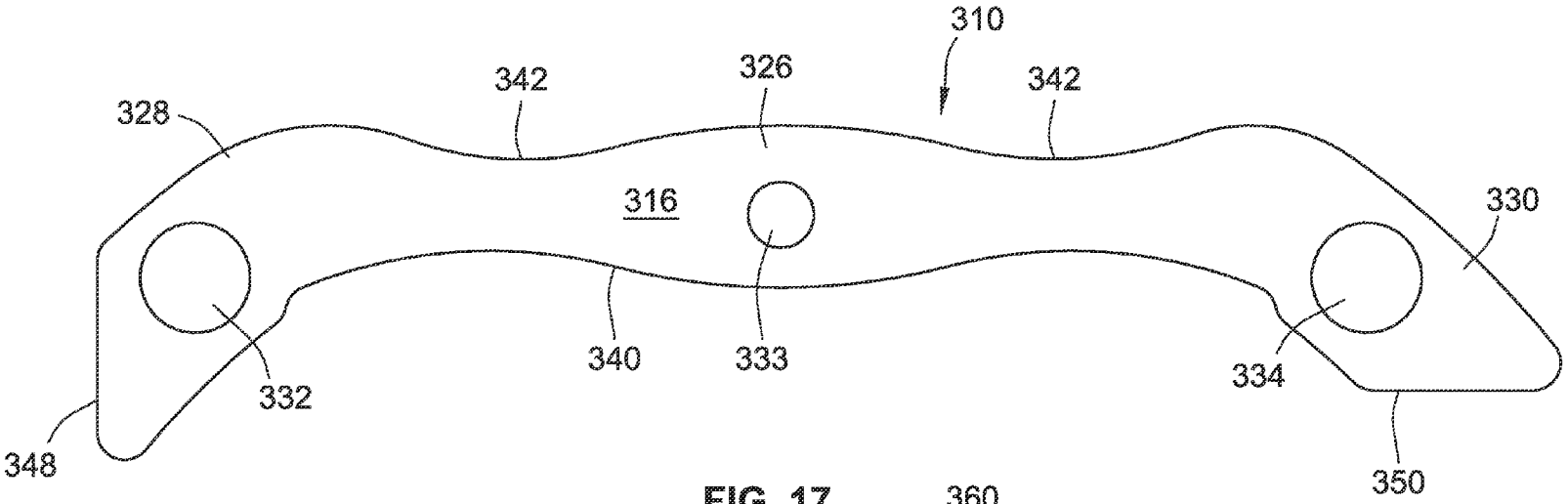
FIG. 17 is a top view of the holding plate employed in FIGS. 15-16.

Turning now to FIGS. 15-17, it can be seen that a holding plate 310 secures the pilot ring 160 and the fixed scroll body 110. These figures show an embodiment with the components of the pilot ring 160, fixed scroll body 110, crankcase 42, and holding plate 310 assembly, which are interchangeable or usable in the described the scroll compressor assembly 10 of the prior figures. Therefore, like reference numbers are used.

It should be noted that in this type of an arrangement and as described for earlier figures, the pilot ring 160 is separated from the fixed scroll body 110 by a gap 312 (defined between the cylindrical inner wall 169 and outer perimeter surface 119). This gap 312 is specifically defined for purposes of functioning as a pilot to allow for surface-to-surface contact between the non-orbiting fixed scroll body and the pilot ring during operation of the scroll compressor assembly 10. This gap defined between the pilot ring and the piloted surface of the fixed scroll is less than 1 millimeter to facilitate piloting, more typically 200 micron or 100 micron or less. Additionally, the pilot ring as shown is not in direct contact with or touching or directly supported by the outer shell or housing assembly as shown in prior figures. Instead, the pilot ring 160 is preferably attached to the crankcase 42 in which the crankcase is then press-fit or otherwise secured to the housing assembly as described for earlier figures. In other embodiments, the pilot ring may be directly attached to the outer housing though.

The holding plate 310 in this embodiment is configured to maintain angular relative positions to prevent rotation between the fixed scroll body 110 and the pilot ring 160 while allowing limited relative axial and radial movement between these components for axial and radial compliance. Indeed, contact between the pilot ring 160 and the fixed scroll 110 is intended during operation due to the control gap 312 that is provided. Thus, the pilot ring 160 pilots and controls or limits the movement available to the fixed scroll body 110 such that it is generally considered fixed or non-movable in comparison to the movable scroll body 112 shown in prior figures that is driven along a substantial orbital path. Further, the holding plate 310 prevents relative rotation between the fixed scroll body 110 and the pilot ring 160 by setting the angular positions of these components relative to each other.

In this embodiment, the holding plate 310 forms surface-to-surface contact with the fixed scroll body 110 in a plane 314 that is transverse to the central axis 54 and extending horizontally, that is primarily in the horizontal direction. More preferably, the holding plate 310 forms surface-to-surface contact along the plane 314 that is horizontal and perpendicular to the vertical or central axis 54 of the compressor. As is typical in scroll compressors, the central axis 54 is typically vertically oriented such that during operation the oil will drain into an oil sump as previously described at the bottom of the scroll compressor assembly.

The common plane 314 can be defined by the pilot ring and the fixed scroll body as shown for example.

As shown, the holding plate 310 lies generally flat with a flat top surface 316 and flat bottom surface 318, both of which extend a full length of the holding plate in an embodiment.

To facilitate mounting of the holding plate 310, the non-orbiting or fixed scroll body 110 comprises a shoulder 320 along an upper or topside and at an outer periphery thereof. The shoulder 320 can be formed from a raised boss region 322 with a machined flat 324 that extends horizontally. The machined flat 324, forms surface-to-surface contact between the non-orbiting scroll and the holding plate and forms part of common plane 314. As shown, a threaded bolt 337 (bolt also referred to as screw) may be used to secure the holding plate 310 to the raised boss region 322 of the fixed scroll body 110. It is also seen that central region 326 of the holding plate 310 is secured to this machined flat or boss region 322.

To secure the holding plate 310 to the pilot ring 160, the holding plate includes opposite end regions 328, 330 which are disposed on opposite sides of the central region 326 with the central region 326 therebetween. As shown, bolts 336, 338 (also referred to as "screws") are used to attach the two end regions 328, 330 of the holding plate 310 to the pilot ring 160. In this manner, the fixed scroll body 110 is therefore attached to and secured to the holding plate 310 which in turn is secured to the pilot ring 160 to strictly limit the available movement therebetween that may be afforded via piloting movement and contact afforded by the small gap 312 to fix the position of the fixed scroll body 110. The holding plate 310 also in this manner prevents relative rotation between the fixed scroll body 110 and the pilot ring 160.

Further, it can be seen that with this configuration, a holding plate and each region thereof includes a mounting hole 332, 333, 334 with each mounting hole projecting in a direction vertically through the holding plate 310 and along holes axes that are parallel with each other. Further, bolts 336, 337 and 338 project through the corresponding holes 332, 333, 334, respectively to secure the holding plate to the pilot ring 160 on the one hand and on the other hand the fixed scroll body 110.

Further, the thinnest dimension of the holding plate may be in the vertical dimension.

For example, the holding plate includes the flat top and bottom surfaces 316, 318 with an outer peripheral edge 340 extending vertically between the surfaces 316, 318. The outer peripheral edge 340 is also the thickness and defines the minimum dimension in the vertical direction for the holding plate 310. The holding plate also includes a length extending horizontally between the end regions 328, 330, and a width extending horizontally traversed and preferably perpendicular to the length. With this configuration, the width is smaller than the length but greater than the thickness throughout the holding plate over an entire span of the holding plate. As a result, this provides some flexibility to the holding plate to allow for a limited range of axial movement between the pilot ring 160 and the fixed scroll body 110 by virtue of flexure in the thickness of the holding plate.

Additionally, relative radial movement (relative to central axis 54) is afforded by the holding plate 310 due to flexure in the holding plate in that direction and due to small sub-millimeter gap 312. To facilitate additional flexure, the holding plate may further comprise neck regions 342 disposed on opposite sides of the central region 326. Each neck region 342 is thus defined between the central region 326 and the end regions 328 and 330. Thus, the neck regions 342 are located intermediate of the locations in which the holding plate is mounted by the bolts 336, 337, 338. The width in the neck regions is reduced at the neck regions 342 relative to the other regions 326, 328, 330. As can be seen, the width may therefore be variable and cover a reduced span in the neck regions 342 that is sufficient to allow some flexure in the holding plate 310 to allow contact between the non-orbiting scroll body 110 and the pilot ring 160 during operation of the scroll compressor assembly 10. This allows for the piloting operation and function of the pilot ring to limit and allow for the limited movement compliance.

Preferably, the holding plate 310 may also include a self-locating feature that locates the holding plate 310 relative to the pilot ring 160 so as to maintain precision or accuracy on the size of the pilot gap 312, which is less than a millimeter and typically less than 200 or 100 micron to facilitate the piloting function.

To provide for a piloting feature, the pilot ring 160 includes a first locating surface 344 and a second locating surface 346 defined along the top surface 167 of the pilot ring 160. These locating surfaces 344, 346 extend vertically from the body of the pilot ring 160 and are in the preferred form of a vertical edge. As can be seen, the first locating surface 344 extends traverse relative to the second locating surface 346 and preferably, these located surfaces are oriented perpendicular relative to each other to provide for location in two separate mutually perpendicular planes, and further this feature also does not require the exact precision/tolerances in the overall length of the holding plate. As can be seen in the holding plate contacts each of the locating surfaces 344, 346 against the peripheral edge 340 of the holding plate 310 which serves to self-locate the holding plate.

More specifically, the holding plate 310 includes a first end edge 348 that contacts the first locating surface 344 and a second end edge 350 that contacts the second locating surface 346. The end edges 348, 350 are oriented transverse relative to each other and preferably perpendicular or vertical with the same orientation as that of the locating surfaces 344, 346. Transverse means crosswise or non-parallel, to include various angles.

Due to this self-locating features via the locating surfaces and end edges, during tightening of the various bolts 336, 337, 338, any twisting or displacement of the holding plate 310 during torqueing is eliminated or at least minimized sufficient to maintain the piloting gap 312 within acceptable tolerances at a consistent gap all of the way around fixed scroll body.

Further, an advantage may be that the same bolts 336 and 338 (or both labeled as 168) which are used to connect the holding plate 310 to the pilot ring 160 may also additionally function to secure the pilot ring 160 to the crankcase 42. Thus, this minimizing the amount of labor and also serves to reduce the complexity as well as the different accumulated tolerances between different parts or portions.

To facilitate the mounting and allow for some additional flexure in the holding plate 310, the top surface 167 of the pilot ring 160 may include first and second raised pads in the form of mounting bosses 171 that may be machined to have a recess to include first and second intermediate platforms 352, 354 that provide shoulders along these mounting bosses 171. Further a recessed region 356 is defined between these intermediate platforms 352, 354. As can be seen, the holding plate 310 rests flat along the platforms 352, 354 but is not in contact with the recessed region 356 allowing that section to be free and available for some flexing.

As mentioned above, the outer bolts 336, 338 are aligned with the post 89 of the crankcase 42 and are long bolts that extend through the pilot ring 160 and into threading engagement 91 with the crankcase 42. Thus, bolts 336, 338 not only secure the holding plate 310 to the pilot ring 160 but also secure the pilot ring 160 to the crankcase 42. It should also be noted that the dimensions of the pilot ring are reduced on the outer perimeter or diameter relative to the crankcase. In this fashion, it can be seen with reference to earlier figures that the pilot ring does not contact the outer housing in an embodiment. Instead the pilot ring is connected to the crankcase which in turn is in contact with and secured to the outer housing.

Additional embodiments of holding plates 360, 362, 366 and 368 are shown in FIGS. 18, 19-20, 21, and 22 respectively. Each of these embodiments may be used in conjunction with the fixed scroll body and pilot ring of any of the aforementioned embodiments. Therefore, each of these embodiments will be readily understood to one of ordinary skill in the art as to how it would secure the pilot ring to the fixed scroll in that each of these embodiments of holding plates 360-368 may be substituted for holding plate 310 in various embodiments.

Figure 18:
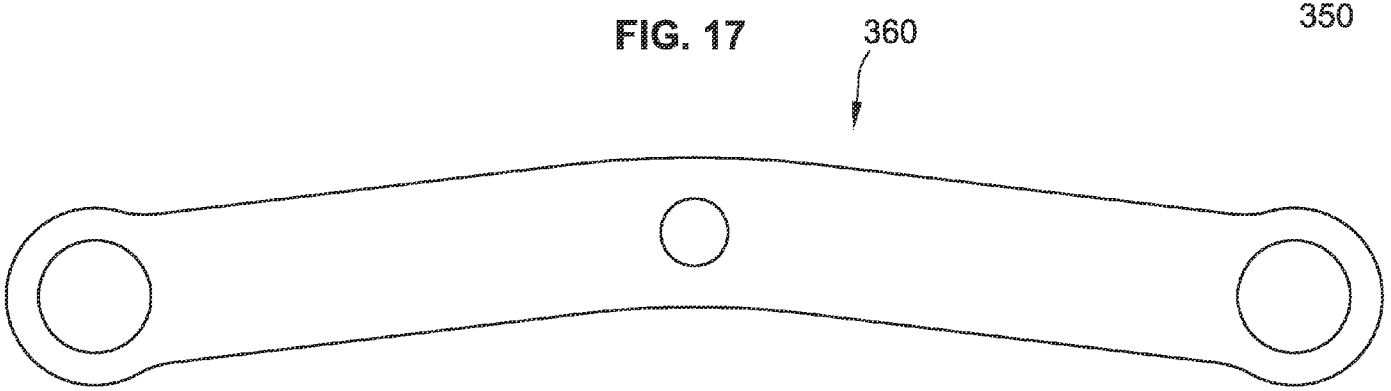
FIG. 18 is a top view of an alternative embodiment of a holding plate that is usable with the scroll compressor assembly shown in prior Figures.

In relation to FIG. 18, holding plate 360 is also shown similar to holding plate 310 to be a flat member that is also untwisted and also makes contact horizontally or along common planes with the fixed scroll body and the pilot ring.

Figure 19:
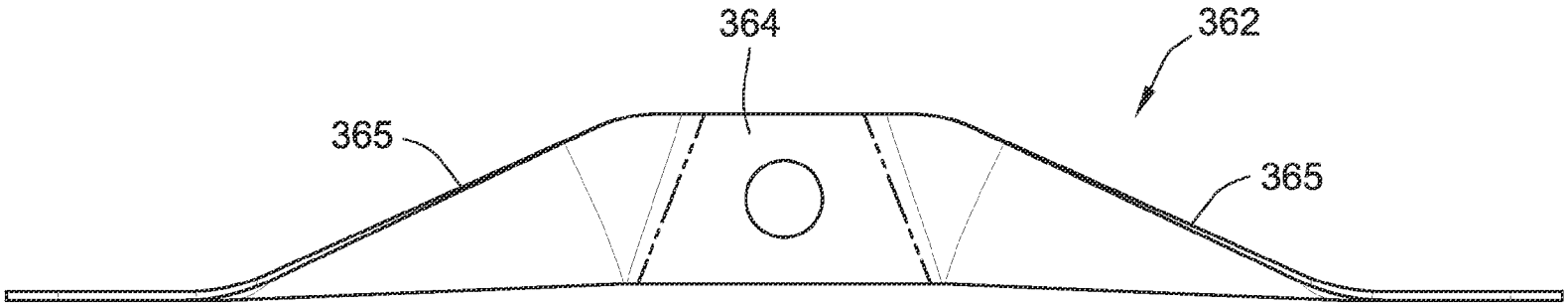
FIG. 19 is a side view of an alternative embodiment of a holding plate that is usable with the scroll compressor assembly shown in prior Figures.
Figure 20:
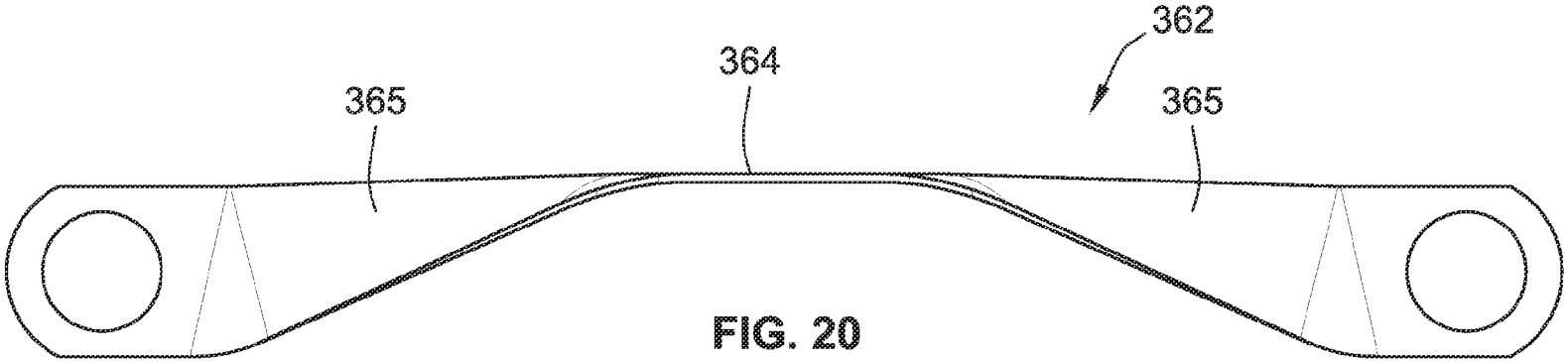
FIG. 20 is a top view of the holding plate shown in FIG. 19.

In FIGS. 19 and 20, another embodiment is shown of a bent but an untwisted holding plate 362 but with various flat or flatter regions intermediate between two defined bends. In this embodiment however, the holding plate 362 would secure to the fixed scroll body along a different plane than the securement to the pilot ring. In particular, in this embodiment, the holding plate 362 has a vertically extending flat section 364 that contacts the fixed scroll body along a vertical plane but contacts the pilot ring via end regions along horizontal planes. However, unlike twisted holding plate examples, this example is untwisted generally to include flat intermediate transition segments 365 that extend between the end regions and the vertical flat region 364, with transitions being formed at bends instead of rotational twist of the holding plate body. Unlike prior art examples, the entire region is not twisted, but spaced apart defined bends are present.

Figure 21:
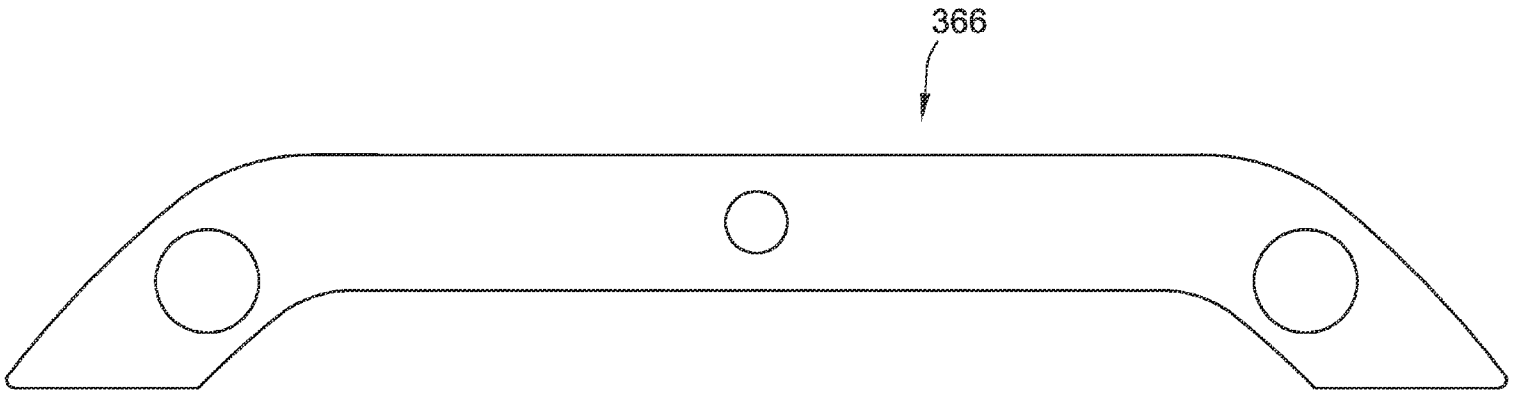
FIG. 21 is a top view of an alternative embodiment of a holding plate that is usable with the scroll compressor assembly shown in prior Figures.

FIG. 21 shows a holding plate 366 where the central mounting hole is offset from the line of the outer mounting holes similar to holding plate 310. Also, it can be seen that this embodiment includes straight end edges similar to prior described end edges 348, 350 although in this case the end edges are parallel for locating only along one plane against the pilot ring.

Figure 22:
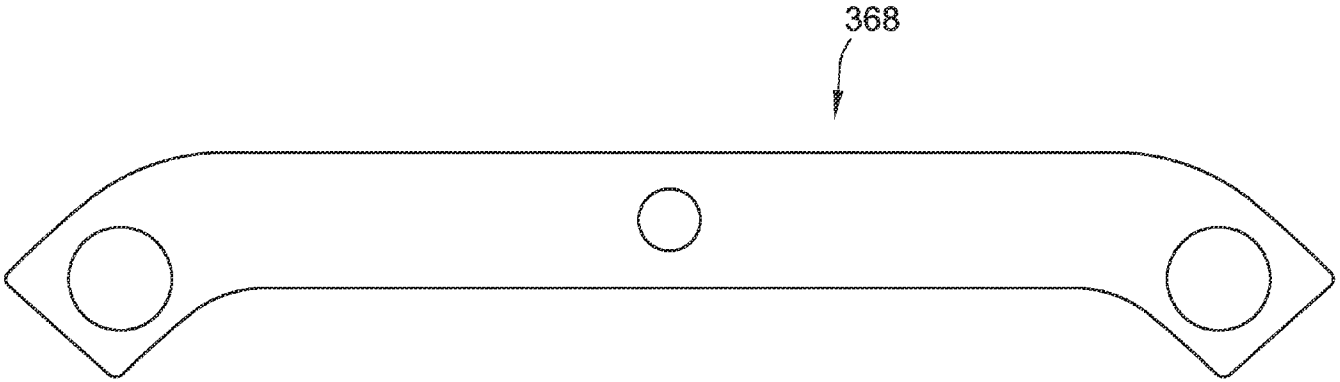
FIG. 22 is a top view of an alternative embodiment of a holding plate that is usable with the scroll compressor assembly shown in prior Figures.

FIG. 22 shows holding plate 368 also with end edges similar to prior described end edges 348, 350 that are oriented for location but in this case, the end edges extend traverse and preferably perpendicular to each other similar to holding plate 310 of the prior embodiment to facilitate location. In this embodiment, the holding plate 368 like holding plate 366, holding plate 360 and holding plate 310 is flat and also contacts both the pilot ring and the fixed scroll body along a common plane.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor, comprising:

a housing;

an orbiting scroll body in the housing, the orbiting scroll body including a first base and a first scroll rib, the first scroll rib projecting from the first base;

a non-orbiting scroll body in the housing, the non-orbiting scroll body including a second base and a second scroll rib, the second scroll rib projecting from the second base, wherein the first and second scroll ribs mutually engage, the orbiting scroll body being movable along a path about an axis relative to the a non-orbiting scroll body for compressing of fluid;

a pilot ring positioned to engage a piloted surface of the non-orbiting scroll body to limit movement of the non-orbiting scroll body in a radial direction; and a holding plate securing the pilot ring and the non-orbiting scroll body to prevent rotation between the non-orbiting scroll body and the pilot ring and to maintain a gap defined between the pilot ring and the piloted surface of 1 millimeter or less for piloting, the holding plate forming surface to surface contact with the non-orbiting scroll body along a contact surface that extends in a contact plane, the contact plane oriented in a direction transverse to the axis, wherein the holing plate contacts the pilot ring in a contact surface region parallel to the contact plane.

2. The scroll compressor of the claim 1, wherein the holding plate forms surface to surface contact with the non-orbiting scroll body in a plane horizontal and perpendicular to the axis, the axis being vertical.

3. The scroll compressor of claim 2, wherein the holding plate includes horizontally flat top and bottom surfaces extending a full length of the holding plate.

4. The scroll compressor of claim 1, wherein the non-orbiting scroll body comprises a shoulder along an upper side at an outer periphery thereof, the shoulder having including a raised boss region with a machined flat extending horizontally, the machined flat forming said surface to surface contact of the non-orbiting scroll with the holding plate.

5. The scroll compressor of claim 1, wherein the holding plate includes opposite end regions and a central region, the central region located between the opposite end regions, the central region secured to the non-orbiting scroll body and the opposite end regions secured to the pilot ring, wherein each region includes a mounting hole, each mounting hole projecting in a direction vertically through the holding plate.

6. The scroll compressor of claim 1, wherein the holding plate comprises: top and bottom surfaces, an outer peripheral edge connecting the top and bottom surfaces, and includes a length extending horizontally, a width extending horizontally transverse to the length, and a thickness extending vertically transverse to the length and the width, the width being smaller than the length and greater than the thickness throughout the holding plate over an entire span of the holding plate.

7. The scroll compressor of claim 6, wherein the holding plate includes opposite end regions and a central region, the central region located between the opposite end regions, the central region secured to the non-orbiting scroll body and the opposite end regions secured to the pilot ring, further comprising neck regions on opposite sides of the central region, each neck region between one of the opposite end regions and the central region, a cross-sectional area in a region of the width being variable and covering a reduced span in the neck regions that sufficient to allow contact between the non-orbiting scroll body and the pilot ring during operation.

8. The scroll compressor of claim 1, wherein the holding plate comprises top and bottom surfaces, and an outer peripheral edge connecting the top and bottom surfaces, wherein the pilot ring includes a first locating surface and a second locating surface, the first and second locating surfaces extending vertically from a body of the pilot ring, the first locating surface extending in a first plane that is transverse to a second plane, the second locating surface being in the second plane, the holding plate adapted to contact the first and second locating surfaces along the outer peripheral edge to locate the holding plate relative to the pilot ring.

9. The scroll compressor of claim 8, wherein the holding plate includes opposite first and second end regions and a central region, the central region located between the opposite end regions, the central region secured to the non-orbiting scroll body and the opposite end regions secured to the pilot ring, and wherein the first end region contacts the first locating surface and the second end region contacts the second locating surface.

10. The scroll compressor of claim 8, wherein the first locating surface and second locating surface extend in the respective first and second planes that are mutually perpendicular.

11. The scroll compressor of claim 1, wherein the pilot ring is formed separately from a crankcase, a plurality of posts extending axially between the crankcase and the pilot ring, the scroll bodies positioned in the attached pilot ring and crankcase, and further comprising fasteners securing the pilot ring and the crankcase, at least two of said fasteners also securing the holding plate to the pilot ring.

12. The scroll compressor of claim 1, wherein the contact surface extends primarily horizontally.

13. The scroll compressor of claim 1, further comprising a motor contained in housing below scroll bodies, the motor having a rotational output on a drive shaft, an eccentric on the drive shaft engaging the orbiting scroll body to impart orbiting movement of the orbiting scroll body during operation of the motor.

14. The scroll compressor of claim 1, wherein the housing comprises an outer annular shell surrounding the pilot ring, the pilot ring is not in contact with but radially spaced from an inner periphery of the outer annular shell, further comprising a crankcase mounted to the pilot ring, wherein a crankcase in is contact with outer annular shell.

15. A scroll compressor, comprising:

a housing;

an orbiting scroll body in the housing, the orbiting scroll body including a first base and a first scroll rib, the first scroll rib projecting from the first base;

a non-orbiting scroll body in the housing, the non-orbiting scroll body including a second base and a second scroll rib, the second scroll rib projecting from the second base, wherein the first and second scroll ribs mutually engage, the orbiting scroll body being movable relative to the a non-orbiting scroll body for compressing of fluid;

a pilot ring positioned to engage a piloted surface of the non-orbiting scroll body to limit movement of the non-orbiting scroll body in a radial direction, a gap defined between the pilot ring and the piloted surface of 1 millimeter or less; and a holding plate securing the pilot ring and the non-orbiting scroll body to prevent rotation between the non-orbiting scroll body and the pilot ring and to maintain the gap for piloting, the holding plate being self-located both axially and rotationally on the pilot ring via contact with at least one shoulder formed on an external surface of the pilot ring.

16. The scroll compressor of claim 15, wherein the holding plate comprises top and bottom surfaces, and an outer peripheral edge connecting the top and bottom surfaces, wherein the pilot ring includes a first locating surface and a second locating surface provided by the at least one shoulder, the first and second locating surfaces being extending vertically from a body of the pilot ring, the first locating surface in a plane extending transverse a second plane, to the second locating surface in the second plane, the holding plate adapted to contact the first and second locating surfaces along the outer peripheral edge to locate the holding plate relative to the pilot ring.

17. The scroll compressor of claim 15, wherein the pilot ring includes a first locating surface and a second locating surface provided by first and second shoulders respectively, and wherein the holding plate includes opposite first and second end regions and a central region, the central region located between the opposite end regions, the central region secured to the non-orbiting scroll body and the opposite end regions secured to the pilot ring, and wherein the first end region contacts a first locating surface and the second end region contacts a second locating surface.

18. The scroll compressor of claim 17, wherein the first locating surface and second locating surface extending in respective planes that are mutually perpendicular.

19. The scroll compressor of claim 15, wherein the pilot ring includes a top surface, the top surface including first and second raised pads providing the first and second shoulders respectively, the first and second raised pads being machined to include first and second intermediate platforms upon which first and second end regions reside, further including a recessed region between the first and second intermediate platforms.

20. The scroll compressor of claim 15, wherein the pilot ring is formed separately from a crankcase, a plurality of posts extending axially between the crankcase and the pilot ring, the scroll bodies positioned in the attached pilot ring and crankcase, and further comprising fasteners securing the pilot ring and the crankcase, at least two of said fasteners also securing the holding plate to the pilot ring, the external surface preventing relative rotation between the holding plate and the pilot ring during torqueing of the screws.

21. A scroll compressor, comprising:

a housing;

an orbiting scroll body in the housing, the orbiting scroll body including a first base and a first scroll rib, the first scroll rib projecting from the first base;

a non-orbiting scroll body in the housing, the non-orbiting scroll body including a second base and a second scroll rib, the second scroll rib projecting from the second base, wherein the first and second scroll ribs mutually engage, the orbiting scroll body being movable relative to the a non-orbiting scroll body for compressing of fluid;

a crankcase, wherein the pilot ring is formed separately from the crankcase, a plurality of posts extending axially between the crankcase and the pilot ring, the scroll bodies positioned in the attached pilot ring and crankcase, a pilot ring positioned to engage a piloted surface of the non-orbiting scroll body to limit movement of the non-orbiting scroll body in a radial direction, a gap defined between the pilot ring and the piloted surface of 1 millimeter or less;

a holding plate securing the pilot ring and the non-orbiting scroll body to prevent rotation between the non-orbiting scroll body and the pilot ring and to maintain the gap for piloting; and fasteners securing the pilot ring and the crankcase, at least two of said fasteners not only securing the pilot ring and the crankcase, but also securing the holding plate to the pilot ring.

22. The scroll compressor of claim 21, wherein the holding plate is located along an external surface of the pilot ring via at least one vertically extending surface that prevents relative rotation between the holding plate and the pilot ring during torqueing of the screws.

23. A scroll compressor, comprising:

a housing;

an orbiting scroll body in the housing, the orbiting scroll body including a first base and a first scroll rib, the first scroll rib projecting from the first base;

a non-orbiting scroll body in the housing, the non-orbiting scroll body including a second base and a second scroll rib, the second scroll rib projecting from the second base, wherein the first and second scroll ribs mutually engage, the orbiting scroll body being movable along an orbital path about an axis relative to the a non-orbiting scroll body for compressing of fluid;

a pilot ring positioned to engage a piloted surface of the non-orbiting scroll body to limit movement of the non-orbiting scroll body in a radial direction; and a holding plate securing the pilot ring and the non-orbiting scroll body to prevent rotation between the non-orbiting scroll body and the pilot ring and to maintain a gap defined between the pilot ring and the piloted surface of 1 millimeter or less for piloting, wherein the holding plate includes opposite end regions and a central region, the central region located between the opposite end regions, the central region secured to the non-orbiting scroll body and the opposite end regions secured to the pilot ring, wherein the holding plate comprises top and bottom surfaces and an outer peripheral edge connecting the top and bottom surfaces, wherein the holding plate is untwisted being free of twisted regions.

24. The scroll compressor of claim 23, wherein the top and bottom surfaces extend in a common plane or parallel to the common plane throughout the opposite end regions and the central region.

25. The scroll compressor of claim 23, each end region and the central region include a mounting hole, each mounting hole projecting in a same direction through the holding plate.

26. The scroll compressor of claim 25, wherein the bottom surface of the holding plate is placed horizontally flat upon each of the non-orbiting scroll body and the pilot ring.

27. A scroll compressor, comprising:

a housing;

an orbiting scroll body in the housing, the orbiting scroll body including a first base and a first scroll rib, the first scroll rib projecting from the first base;

a non-orbiting scroll body in the housing, the non-orbiting scroll body including a second base and a second scroll rib, the second scroll rib projecting from the second base, wherein the first and second scroll ribs mutually engage, the orbiting scroll body being movable along a path about an axis relative to the a non-orbiting scroll body for compressing of fluid;

a pilot ring positioned to engage a piloted surface of the non-orbiting scroll body to limit movement of the non-orbiting scroll body in a radial direction; and a holding plate securing the pilot ring and the non-orbiting scroll body to prevent rotation between the non-orbiting scroll body and the pilot ring and to maintain a gap defined between the pilot ring and the piloted surface of 1 millimeter or less for piloting, the holding plate forming surface to surface contact with the non-orbiting scroll body along a contact surface that extends in a contact plane, the contact plane;

wherein the holding plate is untwisted being free of twisted regions in securing the pilot ring and the non-orbiting scroll body.

* * * * *